US010574003B2

(12) United States Patent
Cheng

(10) Patent No.: US 10,574,003 B2
(45) Date of Patent: Feb. 25, 2020

(54) ELECTRICAL CONNECTORS WITH REINFORCED STRUCTURE

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Shan-Yong Cheng, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/178,619

(22) Filed: Nov. 2, 2018

(65) Prior Publication Data

US 2019/0131748 A1 May 2, 2019

Related U.S. Application Data

(60) Provisional application No. 62/581,029, filed on Nov. 2, 2017.

(30) Foreign Application Priority Data

Dec. 20, 2017 (CN) ..... 2017 1 1382138
Feb. 2, 2018 (CN) ..... 2018 2 0182054 U

(51) Int. Cl.
*H01R 13/6597* (2011.01)
*H01R 13/6585* (2011.01)
(Continued)

(52) U.S. Cl.
CPC ..... *H01R 13/6597* (2013.01); *H01R 13/6585* (2013.01); *H01R 13/405* (2013.01);
(Continued)

(58) Field of Classification Search
CPC .. H01R 23/688; H01R 23/02; H01R 23/7073; H01R 13/6585; H01R 13/646;
(Continued)

(56) References Cited

U.S. PATENT DOCUMENTS 8,419,473 B1 * 4/2013 Lan ..... H01R 13/405 439/607.17
8,968,031 B2 * 3/2015 Simmel ..... H01R 13/659 439/660

(Continued)

*Primary Examiner* — Gary F Paumen
(74) *Attorney, Agent, or Firm* — Wei Te Chung; Ming Chieh Chang

(57) ABSTRACT

A pair of locking arms unitarily extends forwardly from opposite inner edges of the transverse bar in a perpendicular manner and are spaced from two opposite side edges of the shielding plate but abutting against the corresponding side edge of the tongue portion. A front end region of each locking arm further grasps a front edge of the tongue portion and optionally connected to the corresponding grounding terminals. The two opposite ends of the transverse bar are also optimally mechanically and electrically connected to the corresponding grounding terminals. The pair of locking arms may extend from two opposite side edges of the shielding plate or from two opposite end regions of the front edge of the shielding plate alternately.

13 Claims, 49 Drawing Sheets

(51) Int. Cl.

| | |
|---|---|
| ***H01R 13/6582*** | (2011.01) |
| ***H01R 107/00*** | (2006.01) |
| ***H01R 13/405*** | (2006.01) |
| ***H01R 24/60*** | (2011.01) |

(52) U.S. Cl.
CPC ..... *H01R 13/6582* (2013.01); *H01R 24/60* (2013.01); *H01R 2107/00* (2013.01)

(58) Field of Classification Search
CPC ..... H01R 13/6597; H01R 13/6582; H01R 13/405; H01R 2107/00; H01R 24/60
USPC ..... 439/660, 607.05
See application file for complete search history.

(56) References Cited

U.S. PATENT DOCUMENTS

| | | | | |
|---|---|---|---|---|
| 9,496,654 | B2 * | 11/2016 | Little | H01R 13/6583 |
| 9,525,243 | B1 * | 12/2016 | Yuan | H01R 13/6585 |
| 2013/0115823 | A1 * | 5/2013 | Wu | H01R 13/6471<br>439/660 |
| 2017/0149164 | A1 * | 5/2017 | Yokoyama | H01R 13/42 |
| 2017/0149172 | A1 * | 5/2017 | Nishikata | H01R 13/627 |
| 2017/0222372 | A1 * | 8/2017 | Wang | H01R 13/6591 |
| 2017/0229799 | A1 * | 8/2017 | Little | H01R 13/6471 |
| 2017/0310501 | A1 * | 10/2017 | Wang | H01R 12/7023 |
| 2017/0365951 | A1 * | 12/2017 | Zhang | H01R 13/50 |
| 2018/0151987 | A1 * | 5/2018 | Zhao | H01R 13/506 |
| 2018/0191102 | A1 * | 7/2018 | Arai | H01R 13/6585 |
| 2018/0337486 | A1 * | 11/2018 | Zhao | H01R 12/724 |
| 2019/0027868 | A1 * | 1/2019 | Tsai | H01R 13/642 |

* cited by examiner

300

400

688

688

ELECTRICAL CONNECTORS WITH REINFORCED STRUCTURE

CROSS REFERENCE TO RELATED APPLICATIONS

This application claims the benefit of, and priority to, U.S. Provisional Patent Application No. 62/581,029, filed Nov. 2, 2017, the contents of which are incorporated entirely herein by reference.

BACKGROUND OF THE DISCLOSURE

1. Field of the Disclosure

The present disclosure relates to an electrical connector, and particularly to an electrical connector made via an insert-molding process with a reinforced shielding plate in the mating tongue, and that connected with simplified wires.

2. Description of Related Arts

USB committee issued a new type electrical connector assembly on Aug. 11, 2014 to allow the plug connector to be inserted into the corresponding receptacle connector in a flippable manner for transmitting both the USB 2.0 and USB 3.1 signals. This new type electrical connector is called USB Type C connector. Because such an electrical connector is relatively small while having more than twenty contacts thereof, the manufacturing method is believed to be a tough issue for the makers. U.S. patent application Ser. No. 15/636,612 filed on Jun. 28, 2017 with the same applicant and one same inventor, discloses the Type C receptacle connector having two rows of terminals on two surfaces of the mating tongue with a stamped metallic shielding plate located therebetween wherein the shielding plate is further equipped with corresponding notched side edges for locking with the corresponding resilient metallic latches of the complementary plug connector. Anyhow, because confrontation/engagement between the notched side edge and the resilient latch may result in metal fatigue, thus resulting in malfunction after repeated use. U.S. Patent Application Publication No. 2017/0222372 discloses the same type connector with the reinforced shielding plate formed by metal injection molding (MIM) or die-casting and having an enlarged locking section in the vertical direction for compliant engagement with the deflectable latch of the complementary plug connector for avoiding the aforementioned metal fatigue after repeated use. Anyhow, the MIM or die-casting method for the shielding plate may complicate manufacturing and increase the weight disadvantageously.

Therefore, using the stamped metallic shielding plate with the enlarged locking areas is preferable.

SUMMARY OF THE DISCLOSURE

Accordingly, an object of the present disclosure is to provide an electrical connector with the stamped metallic shielding plate having an enlarged locking areas around the side locking notches.

To achieve the above object, an electrical connector includes an insulative housing having a base, and a tongue portion extending forwardly from the base and having opposite upper and lower surfaces thereon, a plurality of upper terminals and a plurality of lower terminals with contacting sections exposed upon the corresponding upper surface and lower surface, respectively. A metallic transverse bar is integrally connected on a rear side of the shielding plate and essentially embedded within the base. A pair of locking arms unitarily extend forwardly from opposite inner edges of the transverse bar in a perpendicular manner and are spaced from two opposite side edges of the shielding plate but abutting against the corresponding side edge of the tongue portion.

DETAILED DESCRIPTION OF THE PREFERRED EMBODIMENT

Figure 1:
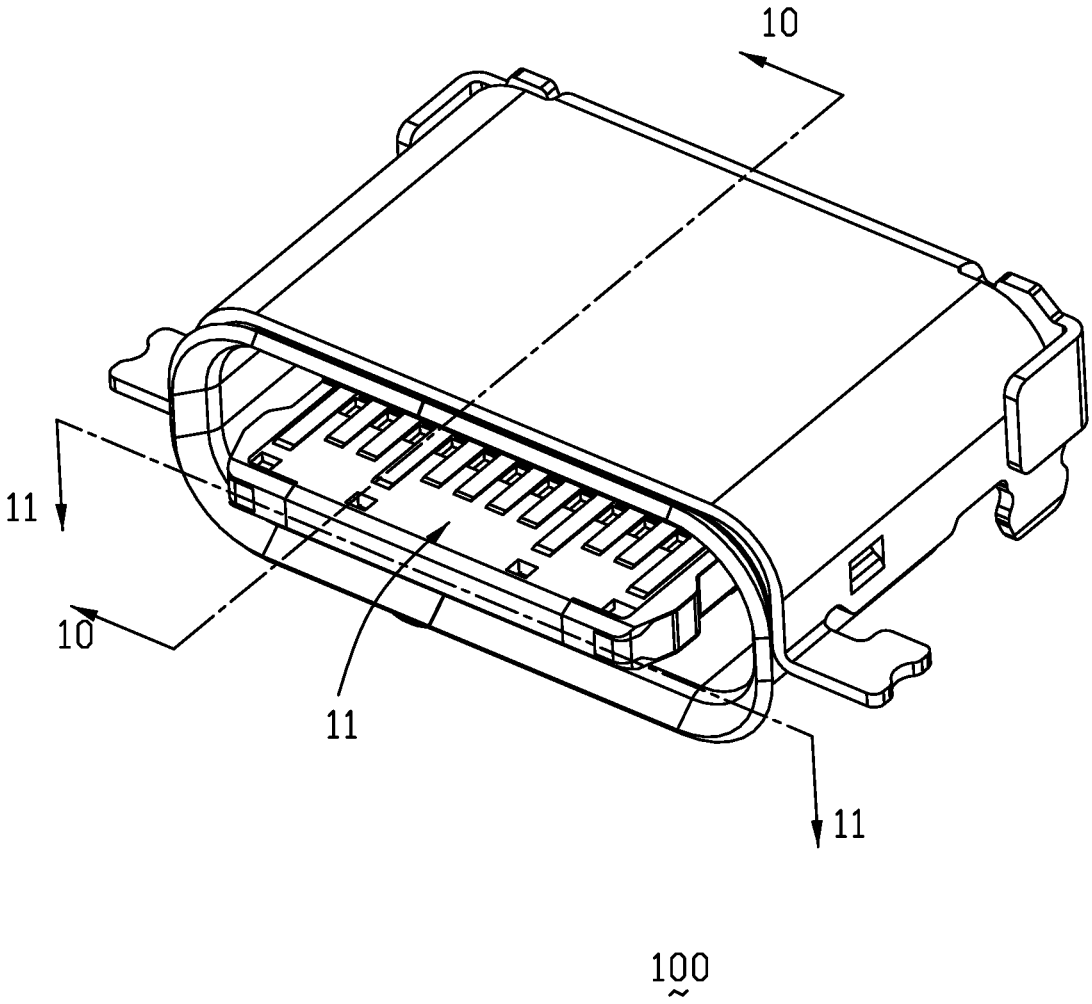
FIG. 1 is a downward perspective view of an electrical connector according to a first embodiment of the invention.
Figure 2:
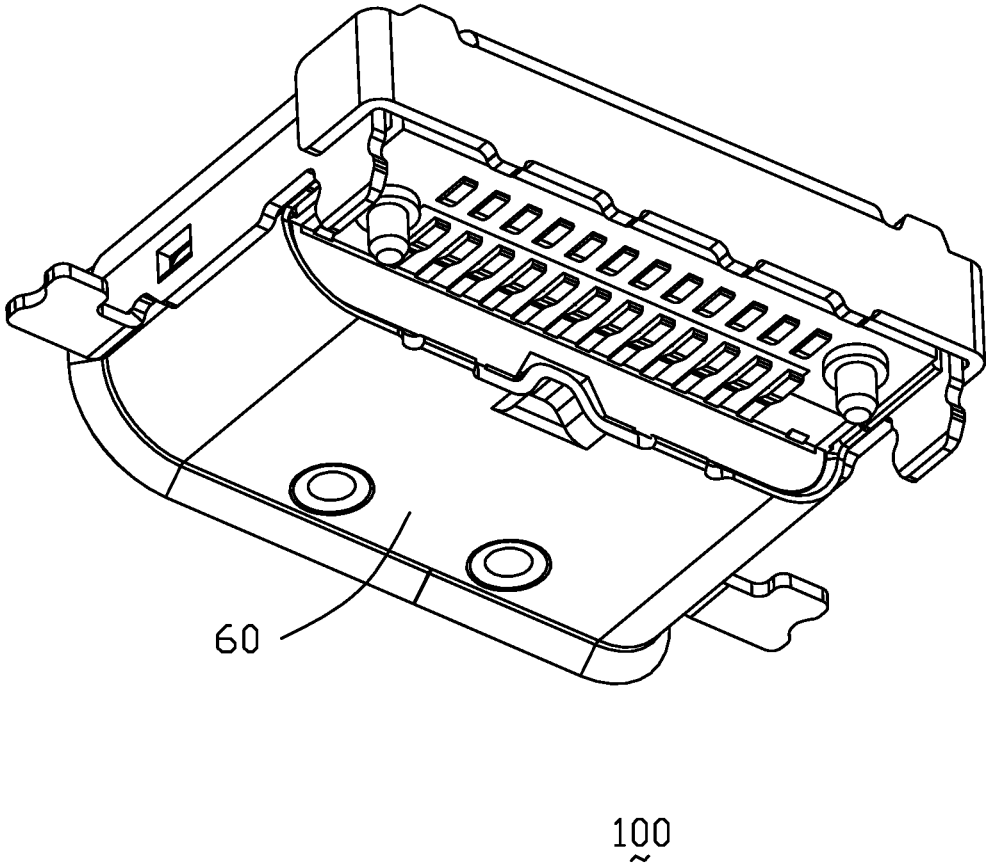
FIG. 2 is an upward perspective view of the electrical connector of FIG. 1.
Figure 3:
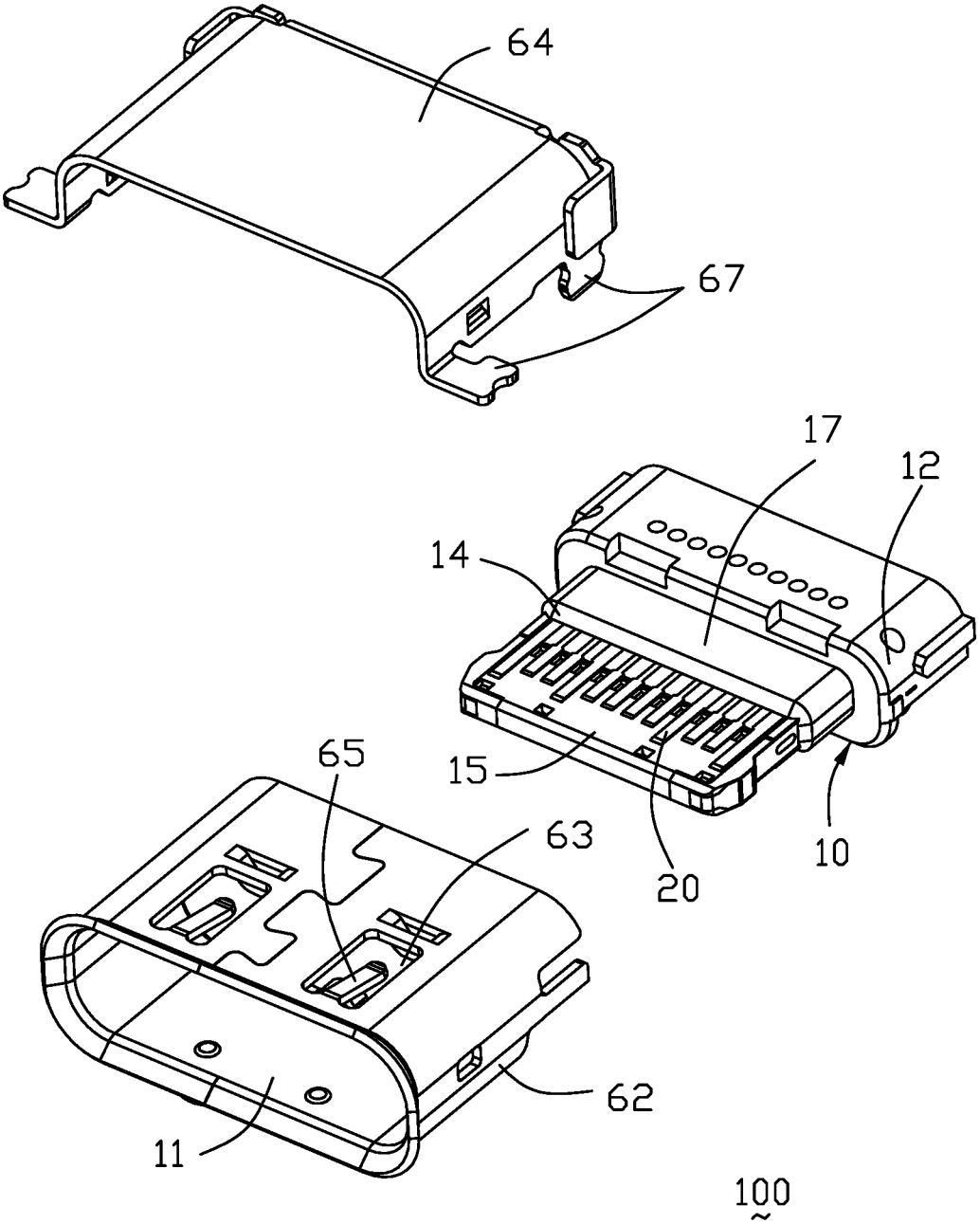
FIG. 3 is an exploded perspective view of the electrical connector of FIG. 1.
Figure 4:
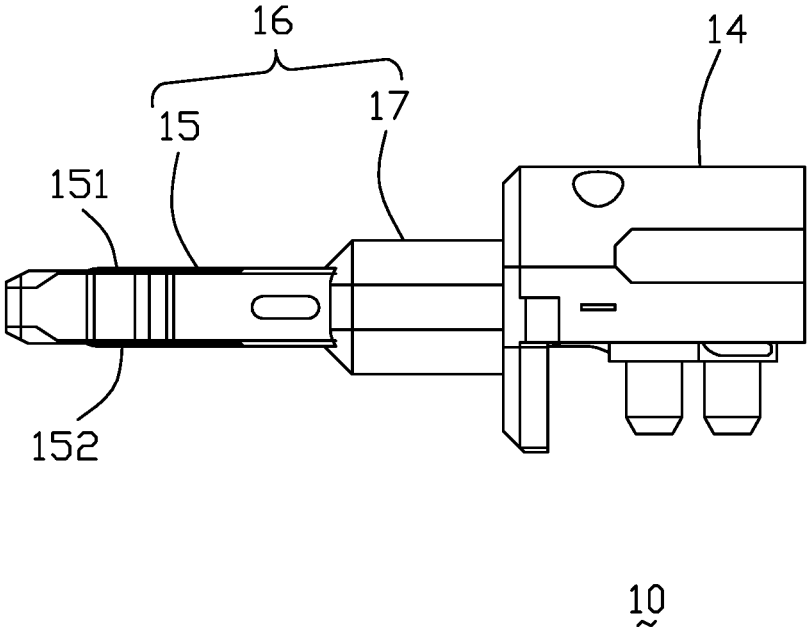
FIG. 4 is a side view of the contact module of the electrical connector of FIG. 1.
Figure 5:
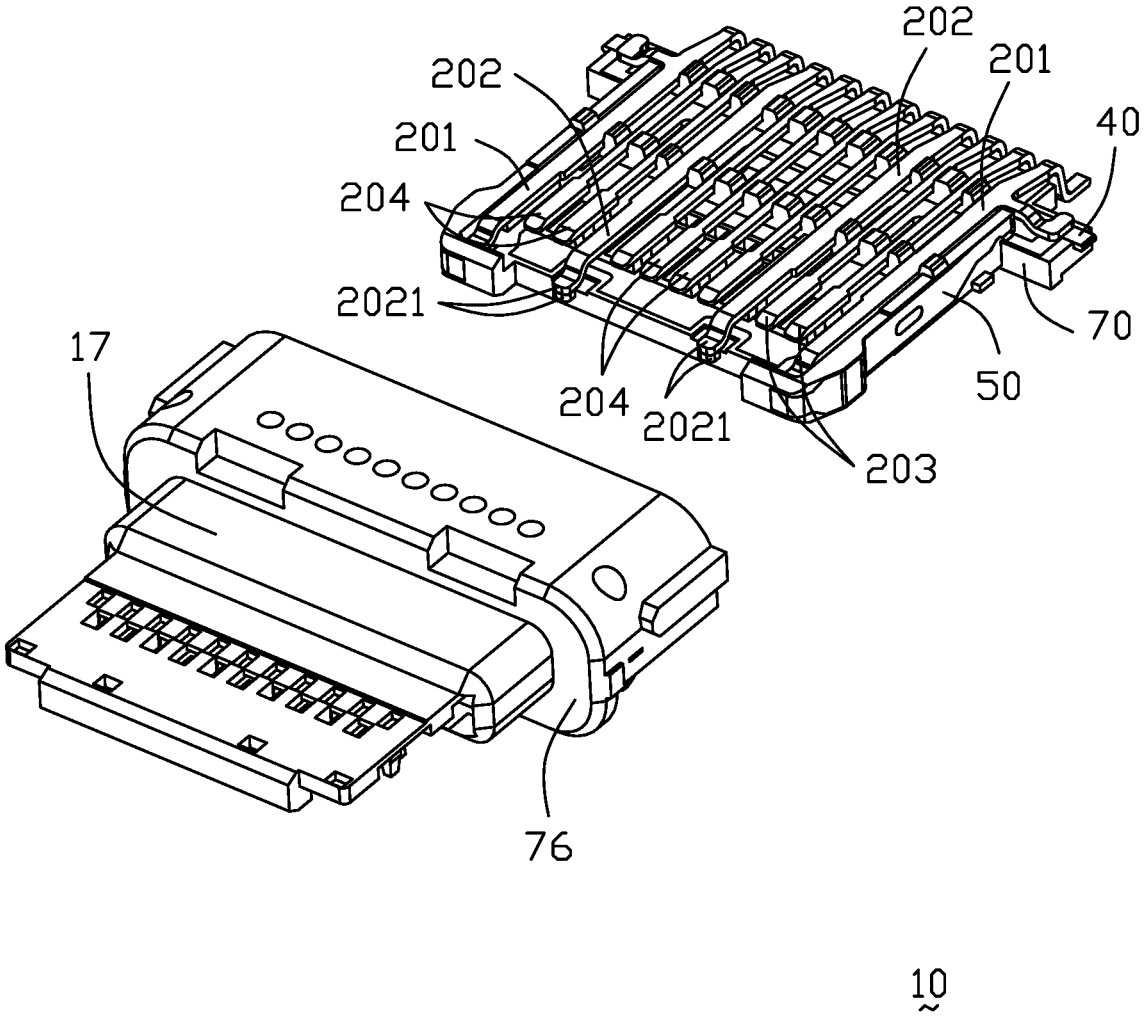
FIG. 5 is an exploded downward perspective view of the contact module of the electrical connector of FIG. 4 with the separated second insulator.
Figure 6:
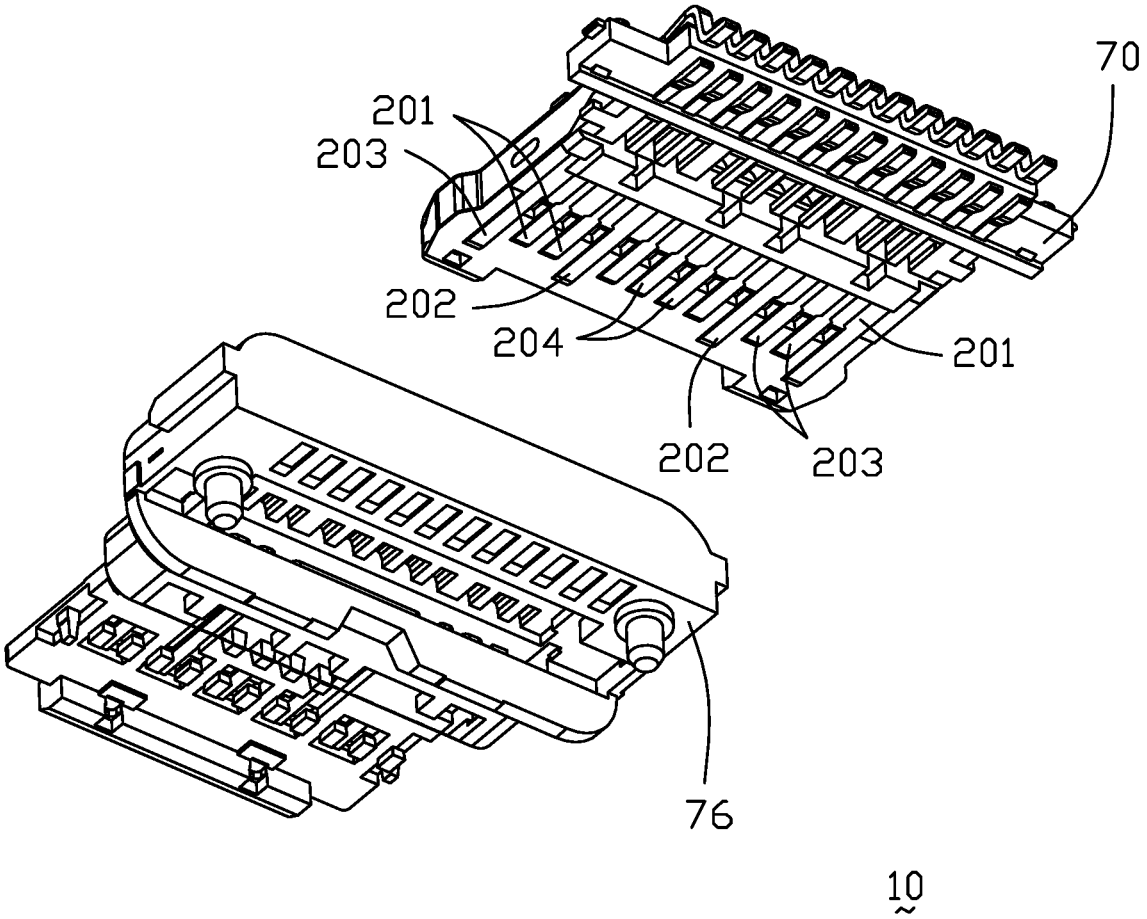
FIG. 6 is an exploded upward perspective view of the contact module of the electrical connector of FIG. 5.
Figure 7:
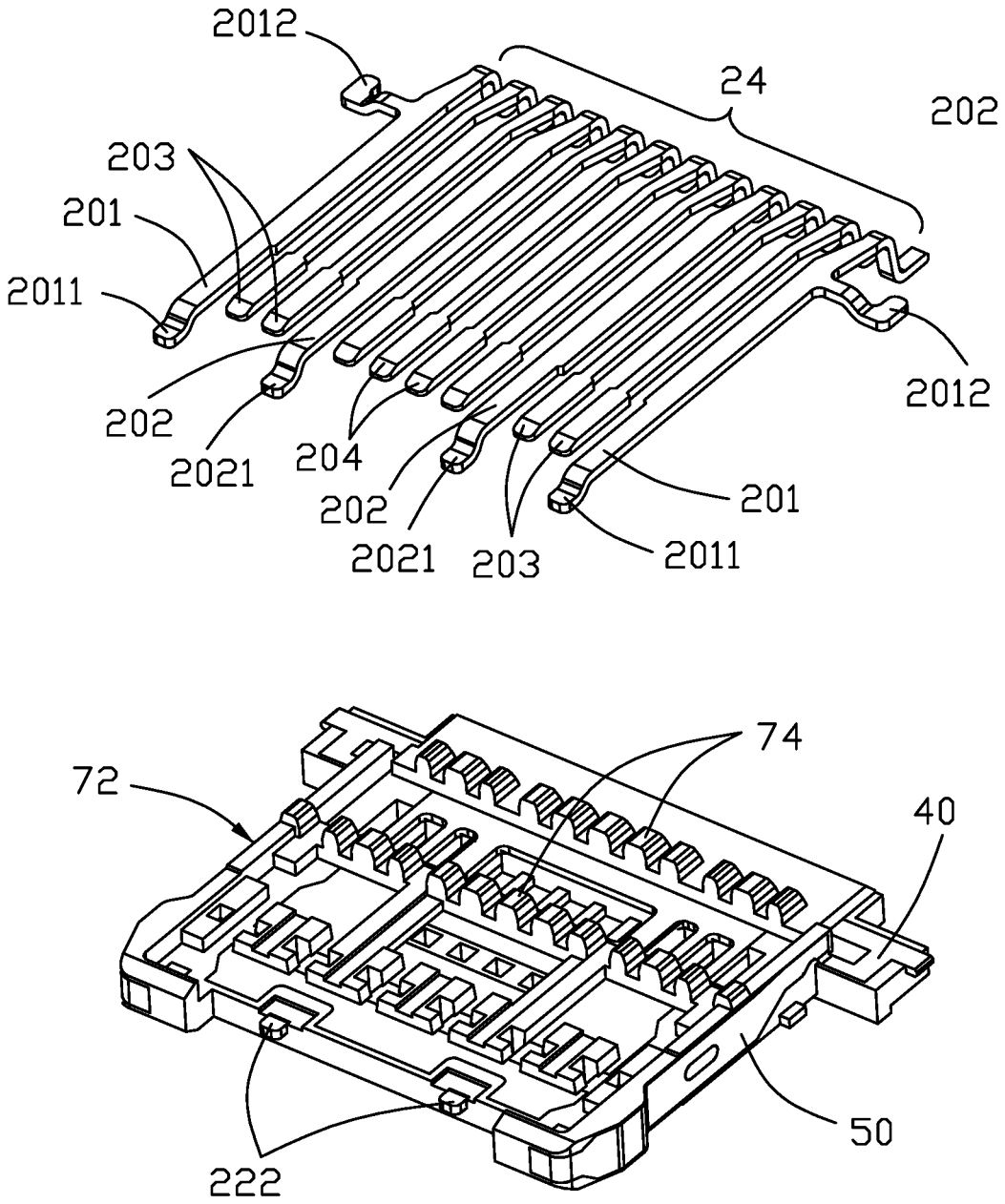
FIG. 7 is an exploded perspective view of the contact module of the electrical connector of FIG. 6 without showing the second insulator.
Figure 8:
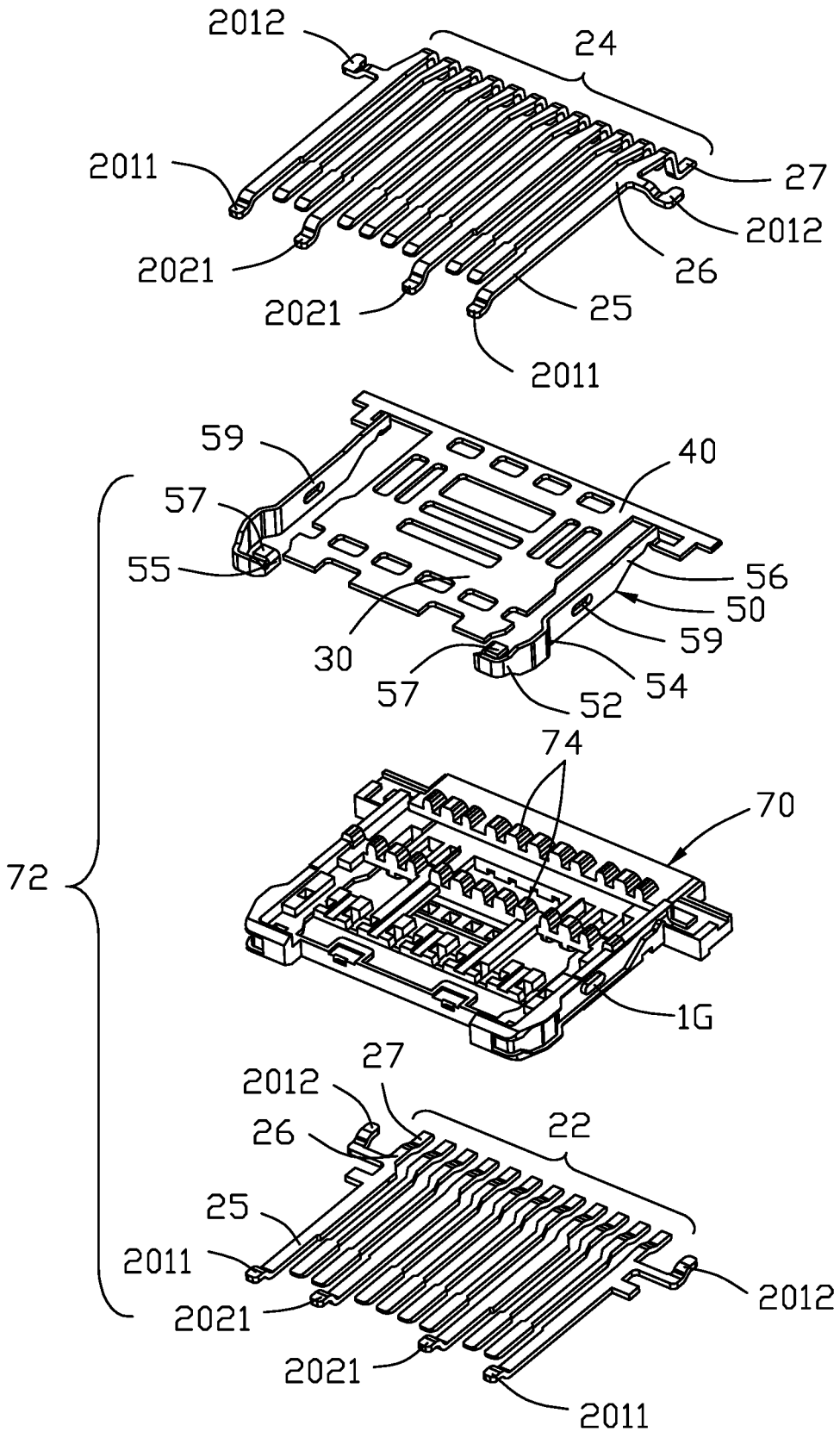
FIG. 8 is a further exploded downward perspective view of the contact module of the electrical connector of FIG. 7.
Figure 9:
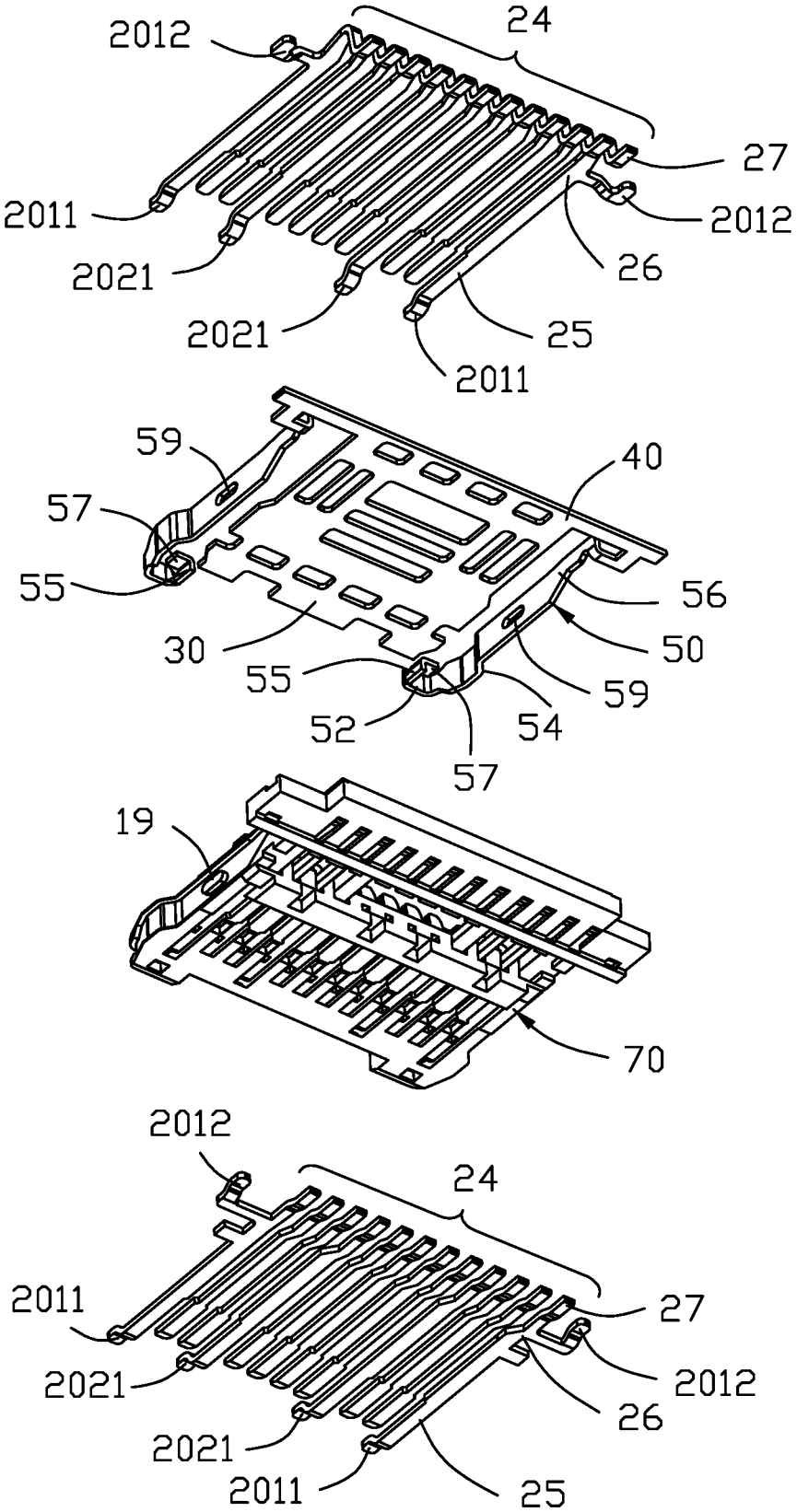
FIG. 9 is a further exploded upward perspective view of the contact module of the electrical connector of FIG. 7.
Figure 10:
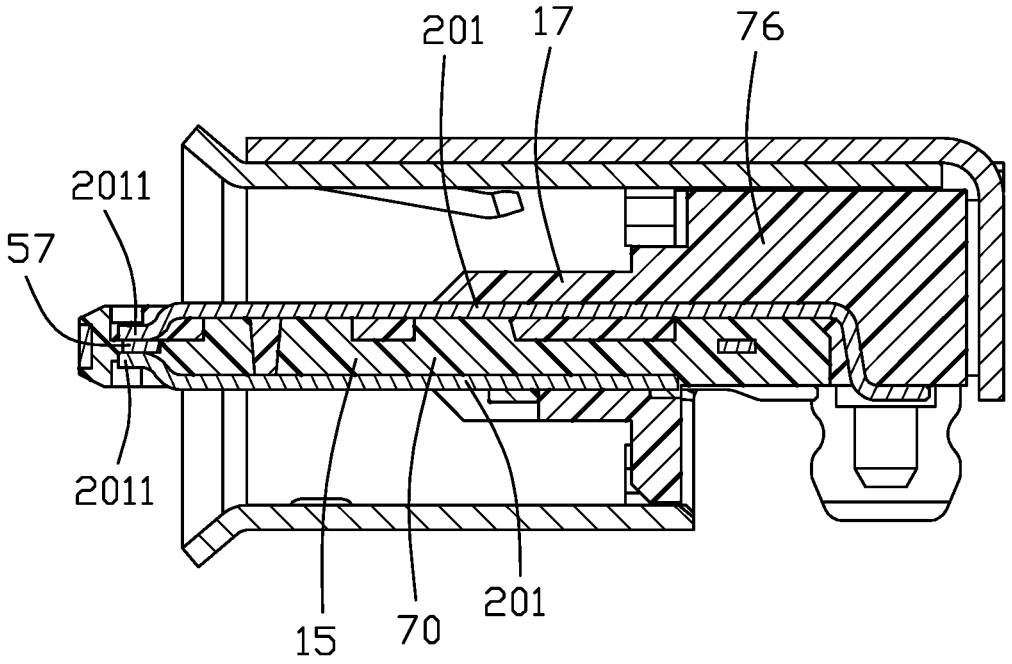
FIG. 10 is a cross-sectional view of the electrical connector of FIG. 1 taken along lines 10-10.
Figure 10A:
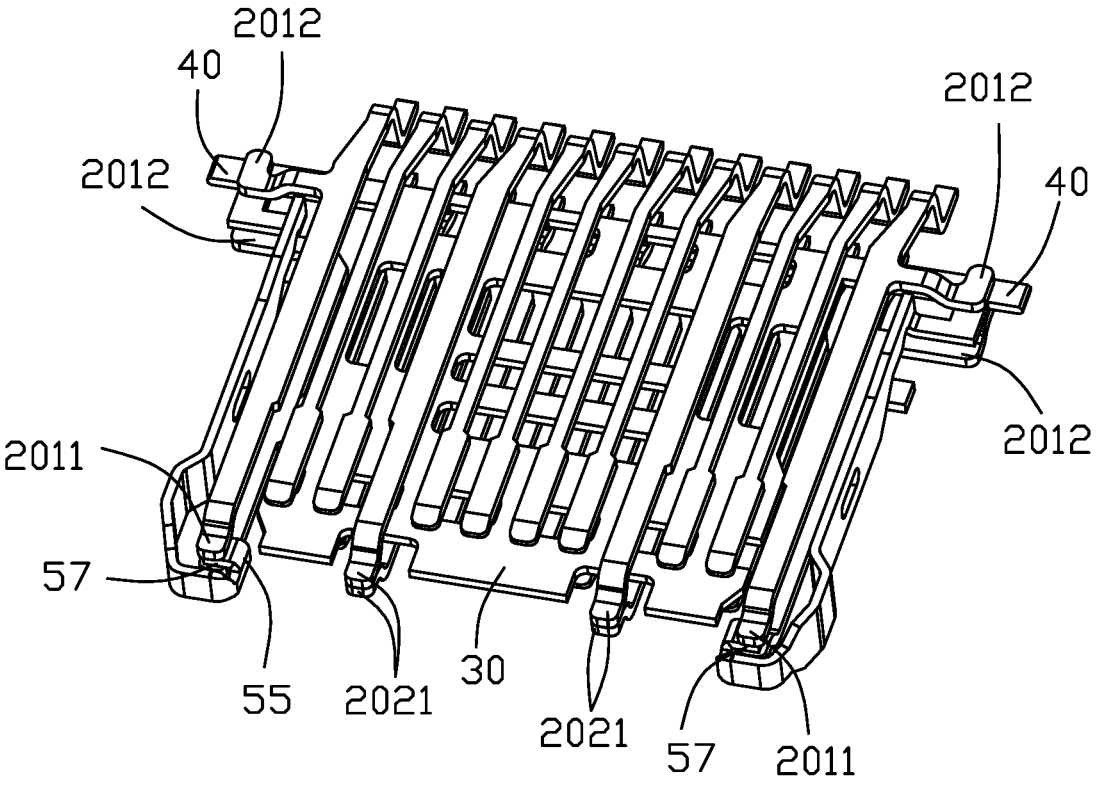
FIG. 10(A) is a downward perspective view to show the shielding plate with the associated transverse bar and locking arms between the upper terminals and the lower terminals for illustrating how the grounding terminals interact with the locking arms and the transverse bar.
Figure 10B:
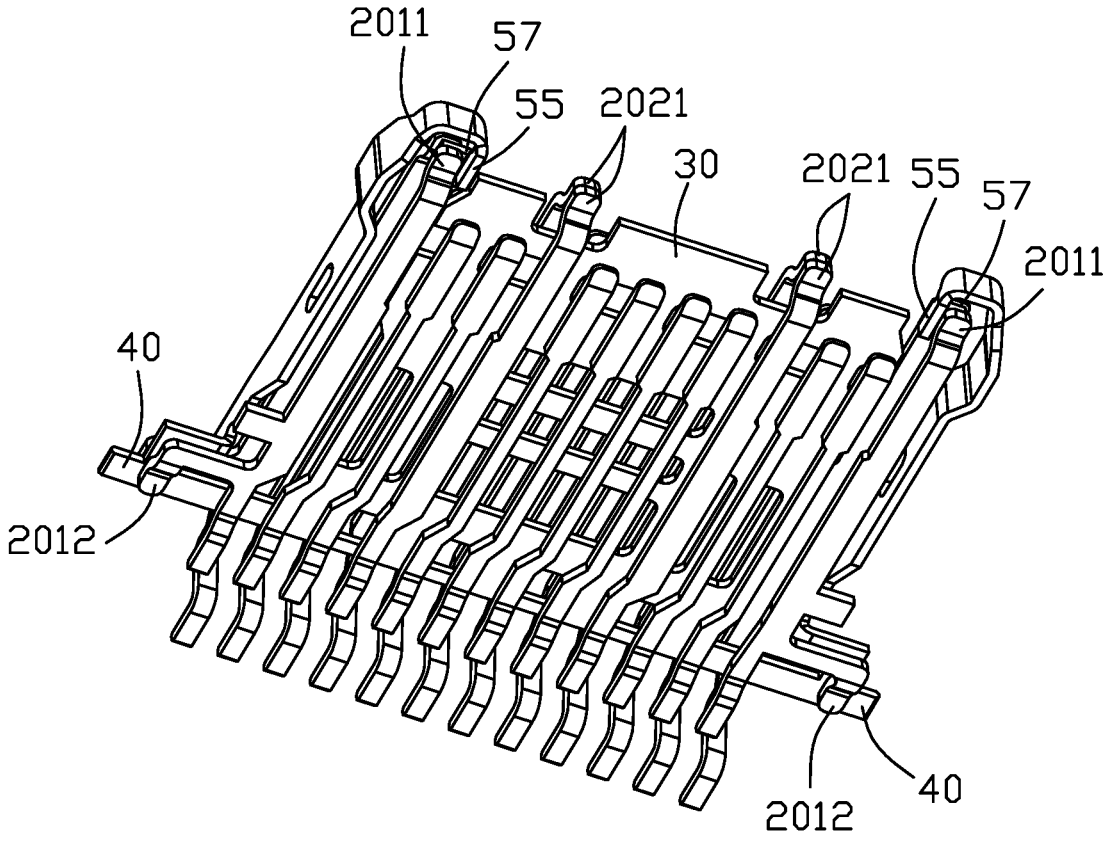
FIG. 10(B) is an upward perspective view of FIG. 10(A)
Figure 11:
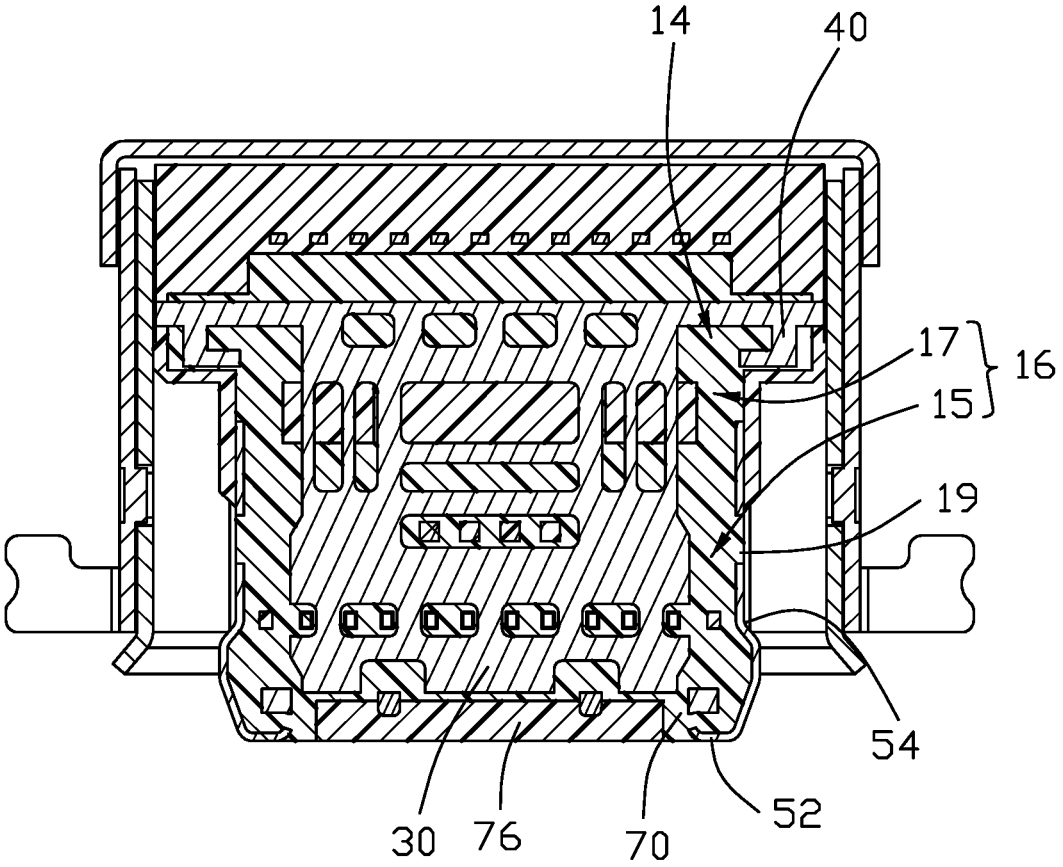
FIG. 11 is another cross-sectional view of the electrical connector of FIG. 1 taken along lines 11-11.

Reference will now be made in detail to the embodiments of the present disclosure. Referring to FIGS. 1-11, an electrical connector 100 complying with the USB Type C receptacle connector standard, includes a contact module 10 and the metallic shell body 60 with a mating cavity 11 therebetween for receiving a complementary plug connector. In this embodiment, the shell body 60 includes an inner shell 62 enclosing the contact module 10, and an outer shell 64 attached upon the inner shell 62 for sealing the openings 63 in the inner shell 62 around the spring tangs 65, and for mounting the whole connector 100 upon the printed circuit board (not shown) via the solder legs 67.

The contact module 10 includes an insulative housing 12 and the terminals 20 secured to the housing 12. The housing 12 includes a base 14 and a tongue portion 16 forwardly extending from a front face (not labeled) of the base 14. In this embodiment, the tongue portion 16 includes a front mating region 15 and a rear step region 17. The terminals 20 include a plurality of lower/first terminals 22 and a plurality of upper/second terminals 24. Each set of the set of lower terminals 22 and the set of upper terminals 24 is arranged along the transverse direction and has the corresponding grounding terminals 201, the power terminals 202, the high speed differential pairs 203, the low speed differential pairs 204, etc. The upper terminals 24 and the lower terminals 22 are reversely symmetrically arranged with each other on the front mating region 15 of the tongue portion 16 so as to allow the corresponding complementary plug connector to be inserted into the mating cavity 11. Each of the terminals 20 has a front mating section 25, a rear mounting section 27 and a middle retaining section 26 therebetween in a front-to-back direction perpendicular to the transverse direction. The front mating sections 25 of the lower terminals 22 and those of the upper terminals 24 are respectively exposed upon two opposite lower and upper surfaces (not labeled) of the mating region 15 of the tongue portion 16. A metallic shielding plate 30 is embedded within the tongue portion 16 of the housing 12 and between the front mating sections 25 of the lower terminals 22 and those of the upper terminals 24 in a vertical direction perpendicular to the front-to-back direction and the transverse direction. A transverse bar 40 embedded within the base 14 behind the tongue portion 16. A pair of locking arms 50 extends forwardly from corresponding inner areas of the transverse bar 40. Each locking arm 50 essentially extends in a vertical manner perpendicular to the lower/upper surface of the front mating region 15 of the tongue portion 16, and has a front end section 52 upon the front edge (not labeled) of the front mating region 15, a locking engagement region 54 linked with the front end section 52 and equipped with a notched structure (not labeled) thereof, and a retaining region 56 behind the locking engagement section 54 wherein both the locking engagement region 52 and the retaining region 56 are intimately exposed upon the corresponding lateral side edge (not labeled) of the front mating region 15, and the retaining region 56 forms an opening 59 to receive a corresponding tab 19 formed on the corresponding lateral side edge of the front mating region 15. Notably, in this embodiment, the shielding plate 30 is unitarily connected with the transverse bar 40 for simplifying manufacturing. In other arrangements, the shielding plate 30 may be separated from the transverse bar 40 with or without connection thereto.

The method of making the electrical connector of the first embodiment as shown in FIGS. 1-11, is similar to what is disclosed in the aforementioned copending patent application Ser. No. 15/636,612, the lower terminals 22 and the shielding plate 30 with the associated transverse bar 40 and the corresponding locking arms 50 are initially integrally formed within a first insulator 70 via a first insert-molding process to form a sub-assembly 72 with a plurality of ribs 74. The upper terminals 24 are disposed upon the sub-assembly 72 and between the ribs 74, respectively, and successively integrally formed with the second insulator 76 to form the complete contact module 10. In other words, the first insulator 70 and the second insulator 76 commonly form the insulative housing 12.

In this embodiment, the front end of each locking arm 50 includes a vertical part 55 and a horizontal part 57 both embedded within the first insulator 70 wherein the horizontal part 57 is intimately sandwiched between front ends 2011 of the corresponding upper grounding terminal 201 and the lower grounding terminal 201 in the vertical direction. Understandably, the front end of the locking arm 50 not only enhances mechanical securing of the locking arm 50 with regard to the housing 12 but also provides the electrical connection with the corresponding grounding terminals 201. In addition, each of the upper grounding terminal 201 and the lower grounding terminal 201 has a side end 2012 to commonly sandwich the transverse bar 40 for grounding. Similar to what is disclosed in the aforementioned patent application Ser. No. 15/636,612, the front ends 2021 of the upper power terminals 202 and lower power terminal 202 abut against each other in the vertical direction. In this embodiment, the locking arms 50 extend from the transverse bar 40 and essentially spaced from the lateral side edge of the shielding plate 30 in the transverse direction so as to ease forming/bending the locking arms 50, compared with some traditional design having the locking arms unitarily directly extending from the side edge of the shielding plate via several bending process in an intimate folded manner.

Figure 12:
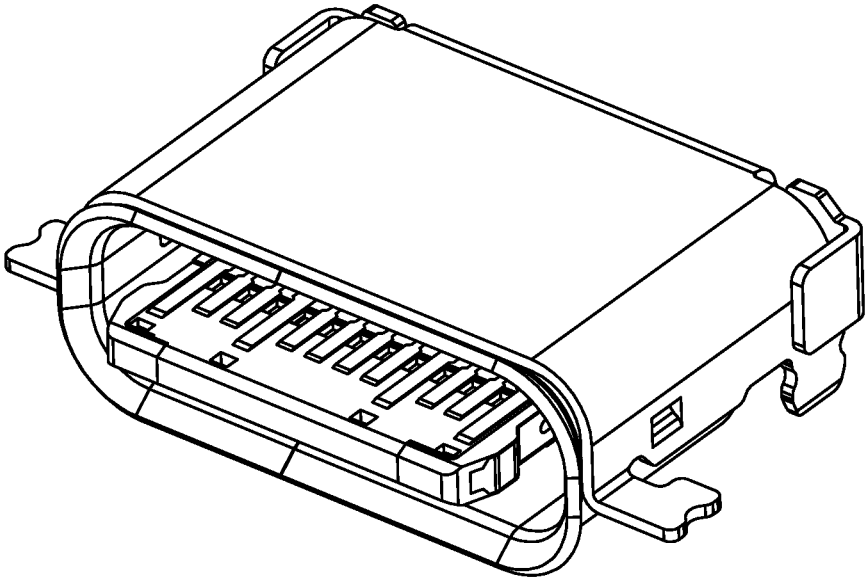
FIG. 12 is a perspective view of an electrical connector according to a second embodiment of the invention.
Figure 13:
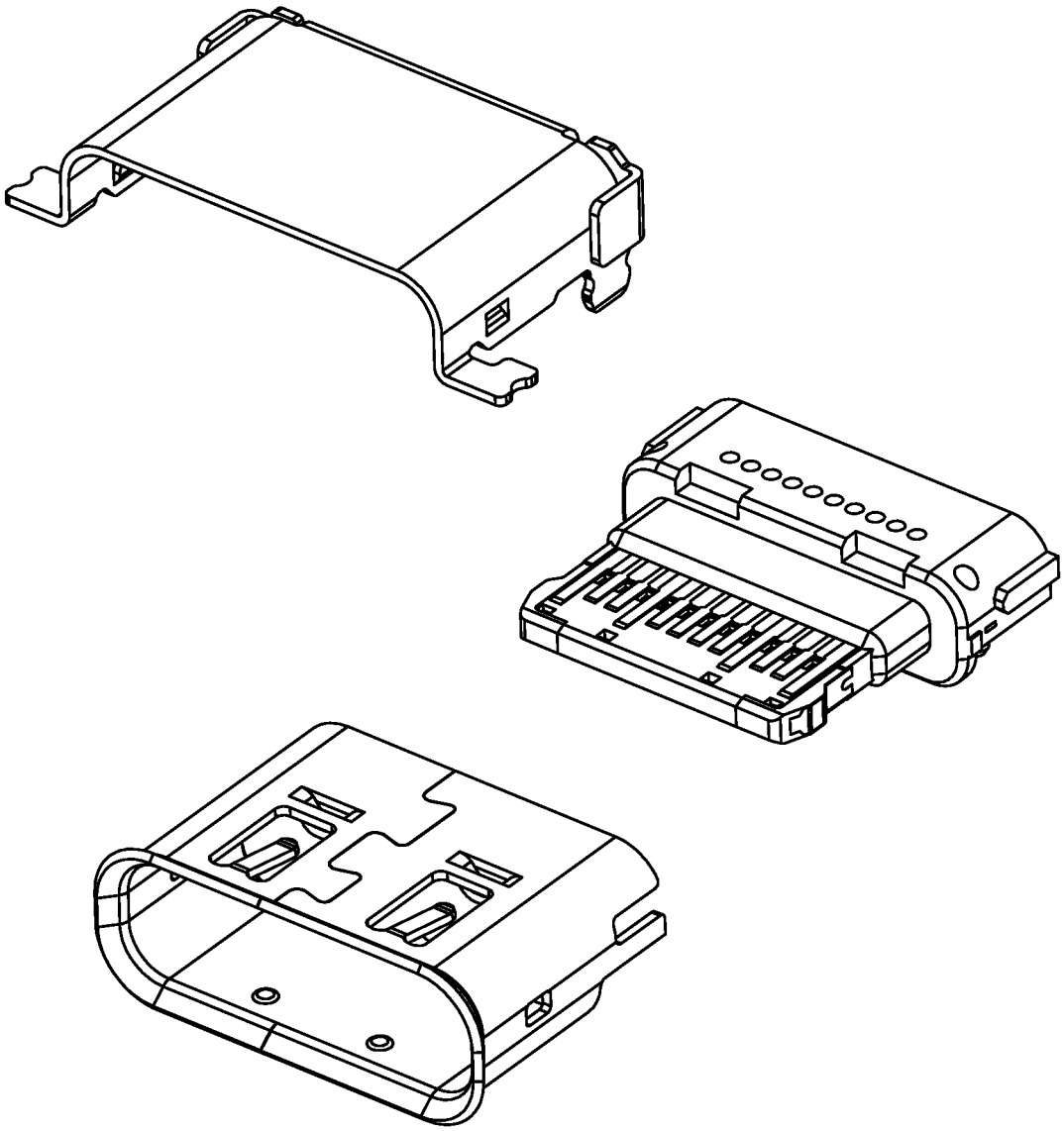
FIG. 13 is an exploded perspective view of the electrical connector of FIG. 12.
Figure 14:
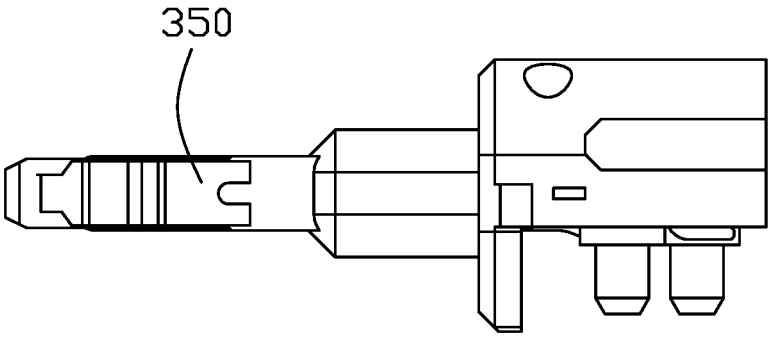
FIG. 14 is a side view of the contact module of the electrical connector of FIG. 12.
Figure 15:
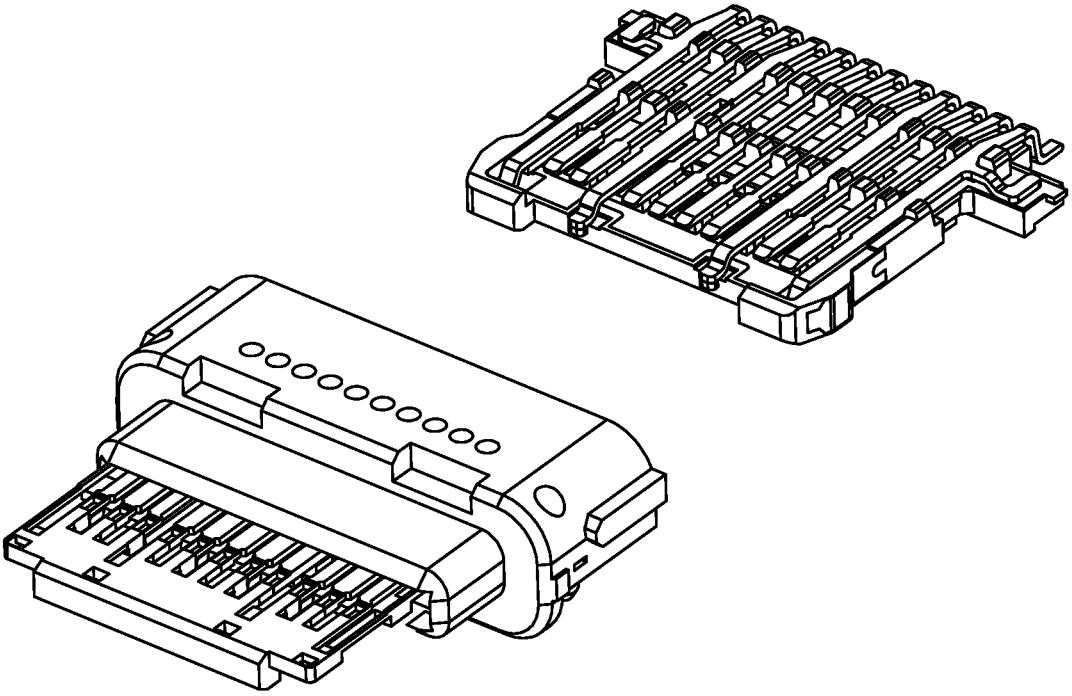
FIG. 15 is an exploded perspective view of the contact module of the electrical connector of FIG. 14.
Figure 16:
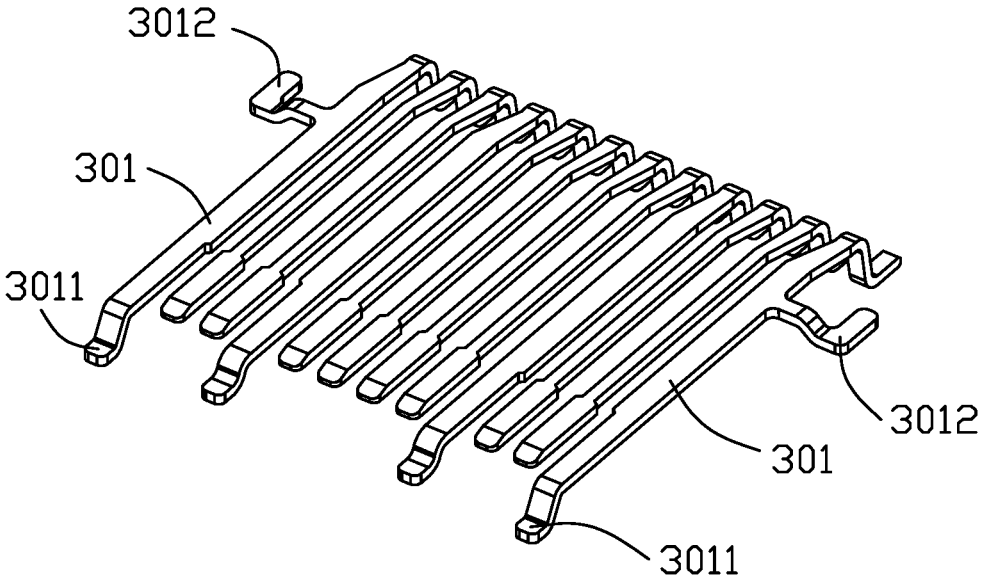
FIG. 16 is a further exploded perspective view of the contact module of the electrical connector of FIG. 15 without the second insulator and the lower terminals.
Figure 16:
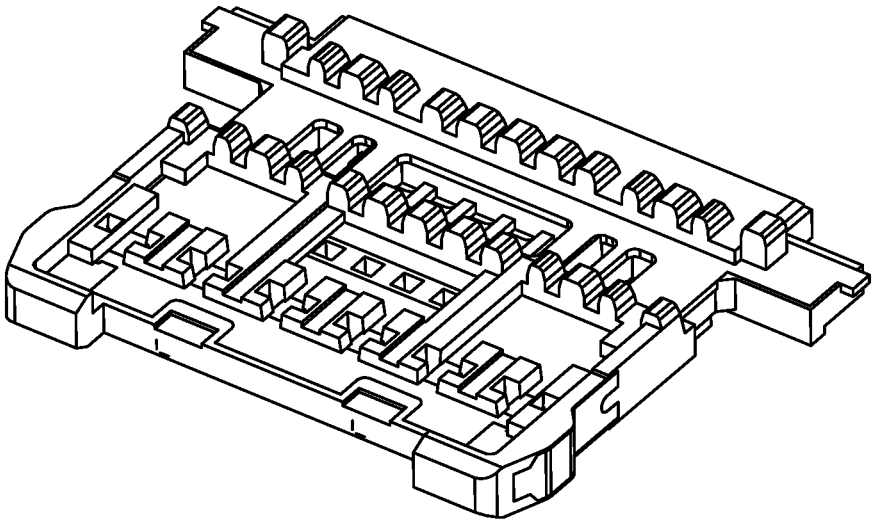
Figure 17:
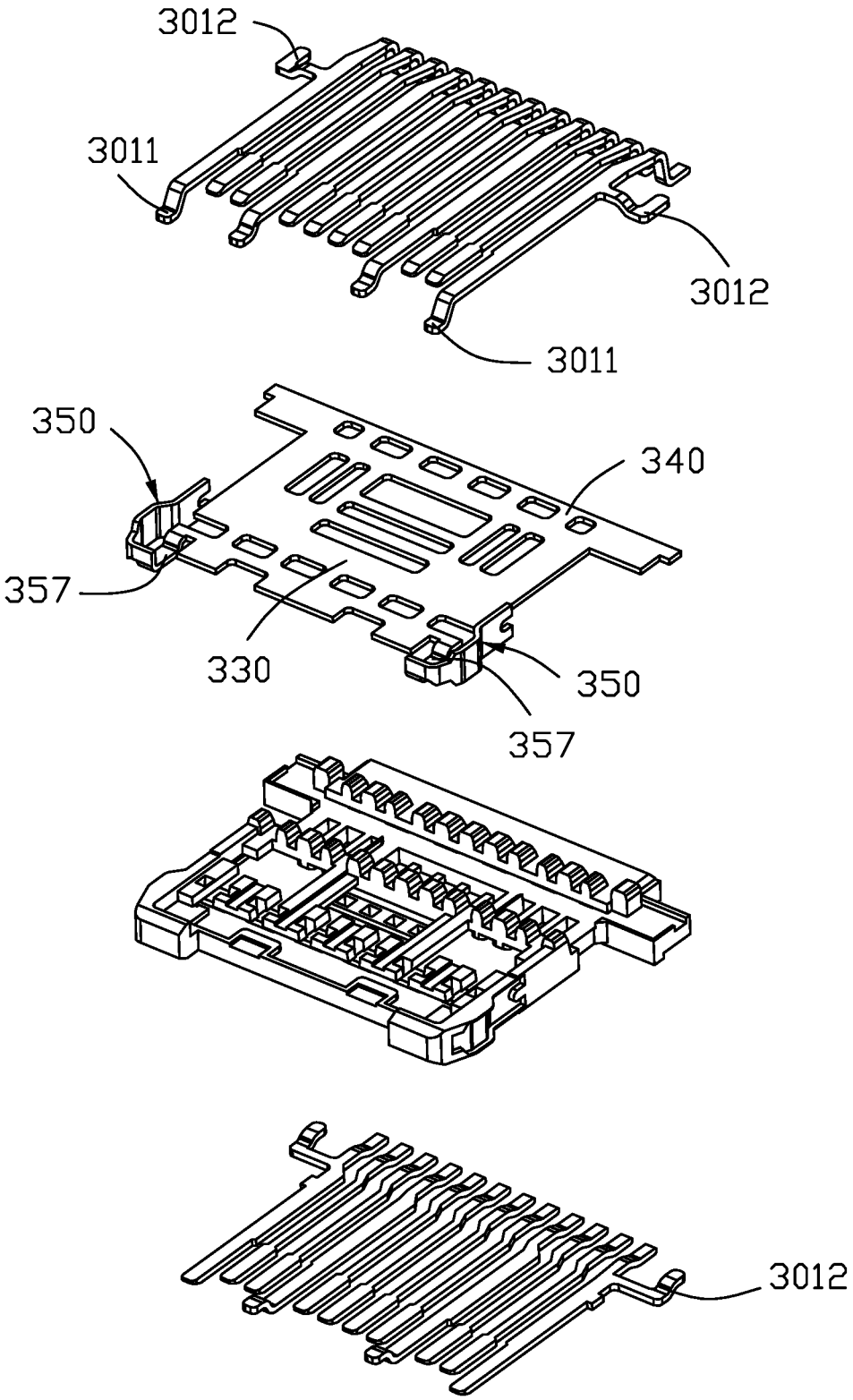
FIG. 17 is a further exploded perspective view of the contact module of the electrical connector of FIG. 15 without the second insulator.
Figure 18:
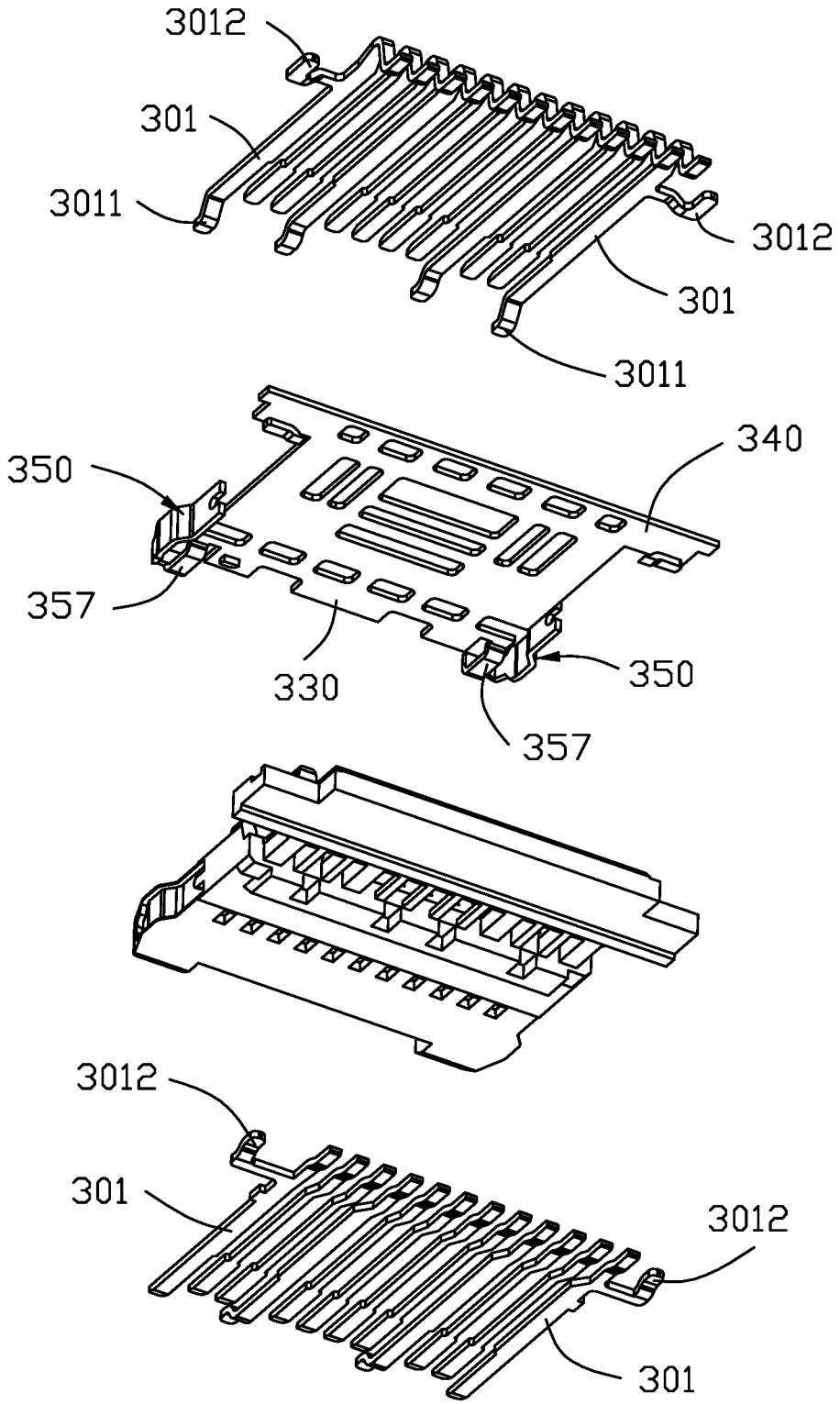
FIG. 18 is another further exploded perspective view of the contact module of the electrical connector of FIG. 15 without the second insulator.
Figure 19:
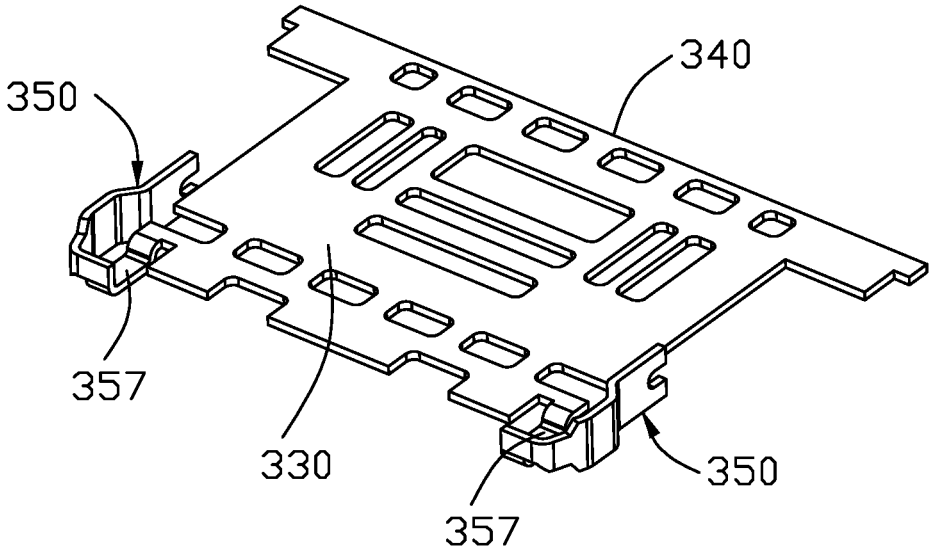
FIG. 19 is a perspective view of the shielding plate with the pair of locking arms and the associated transverse bar of the contact module of the electrical connector of FIG. 17.

FIGS. 12-19 show an electrical connector 300 according to the second embodiment. The basic structure and the assembling process of the electrical connector 300 is similar to those of the electrical connector 100 shown in the first embodiment in FIGS. 1-11 except that the locking arms 350 extend from the front edge of the shielding plate 300 instead of from the transverse bar 340 wherein the horizontal part 357 is only mechanically and electrically connected with the front end 3011 of the corresponding upper grounding terminal 301. Anyhow, the lower grounding terminal 301 still mechanically and electrically connects to the transverse bar 340 via the side end 3012 as well as the upper grounding terminal 301.

Figure 20:
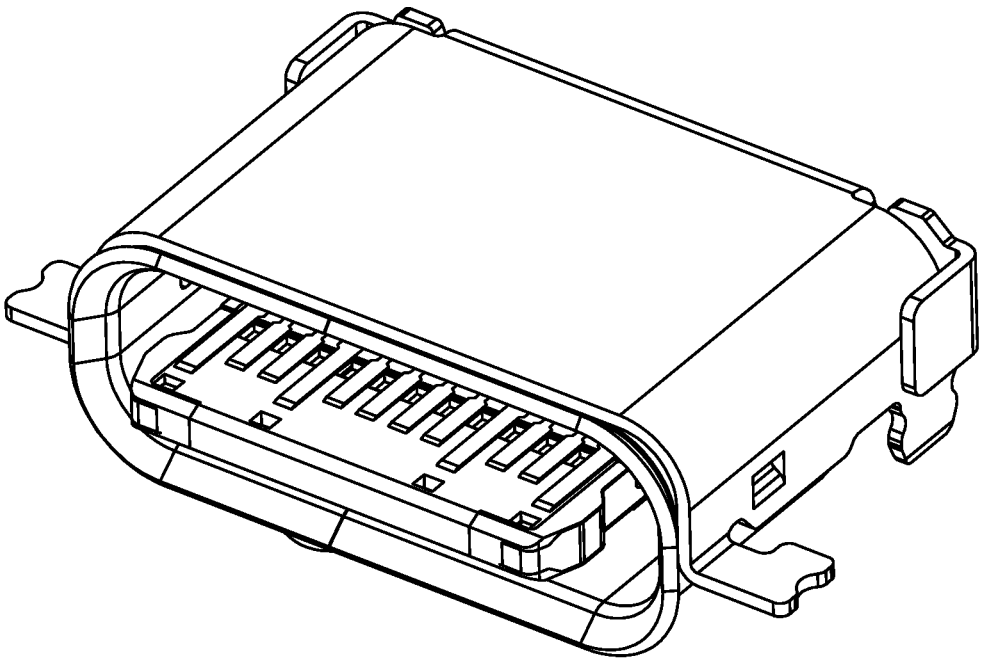
FIG. 20 is a perspective view of the electrical connector according to a third embodiment of the invention.
Figure 21:
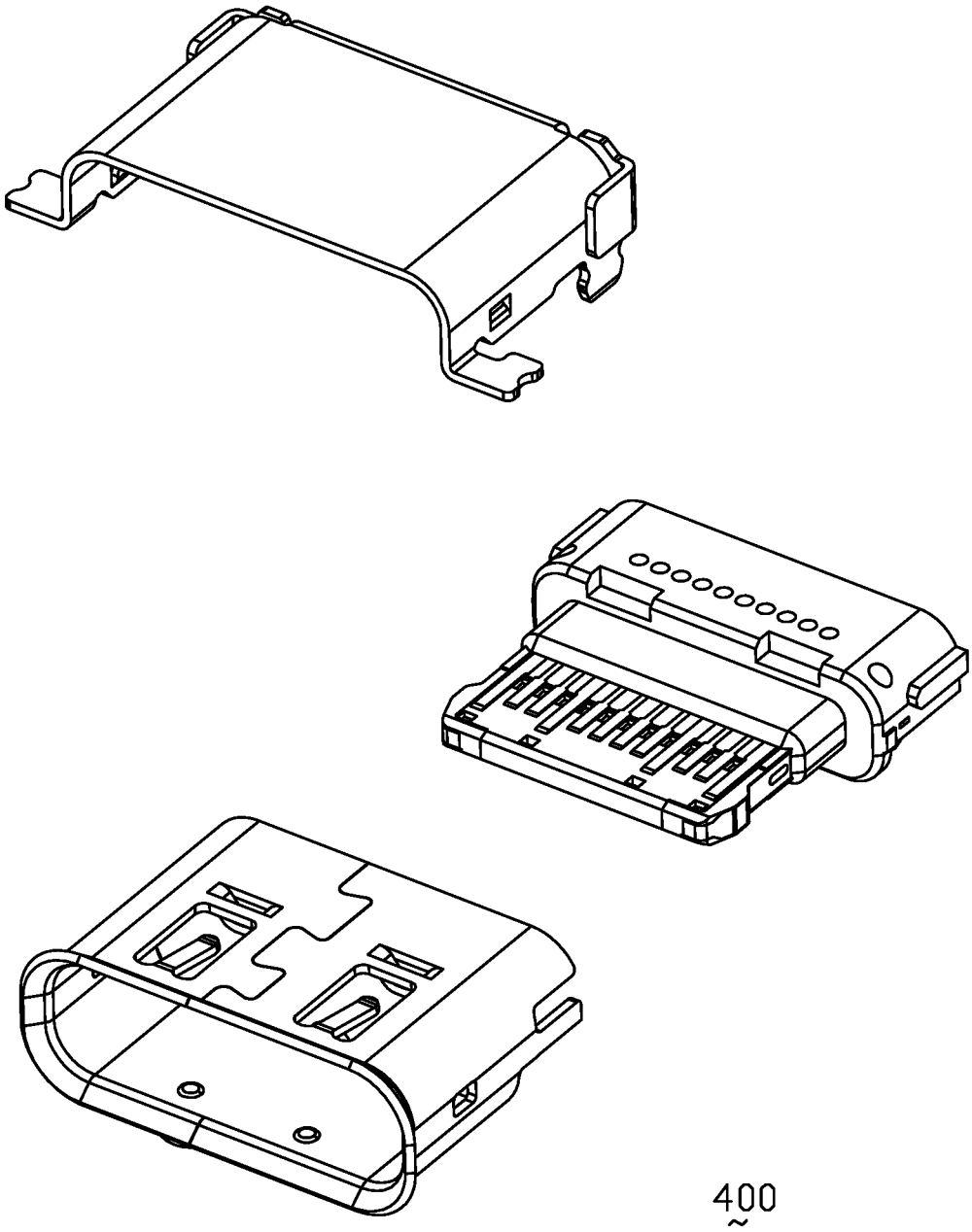
FIG. 21 is an exploded perspective view of the electrical connector of FIG. 20.
Figure 22:
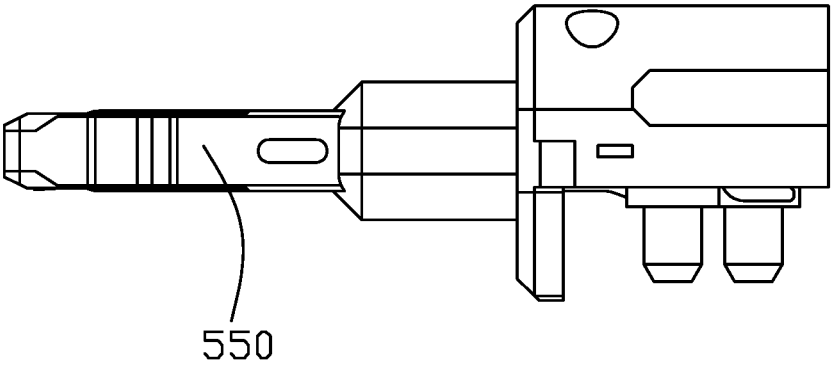
FIG. 22 is a side view of the contact module of the electrical connector of FIG. 20.
Figure 22A:
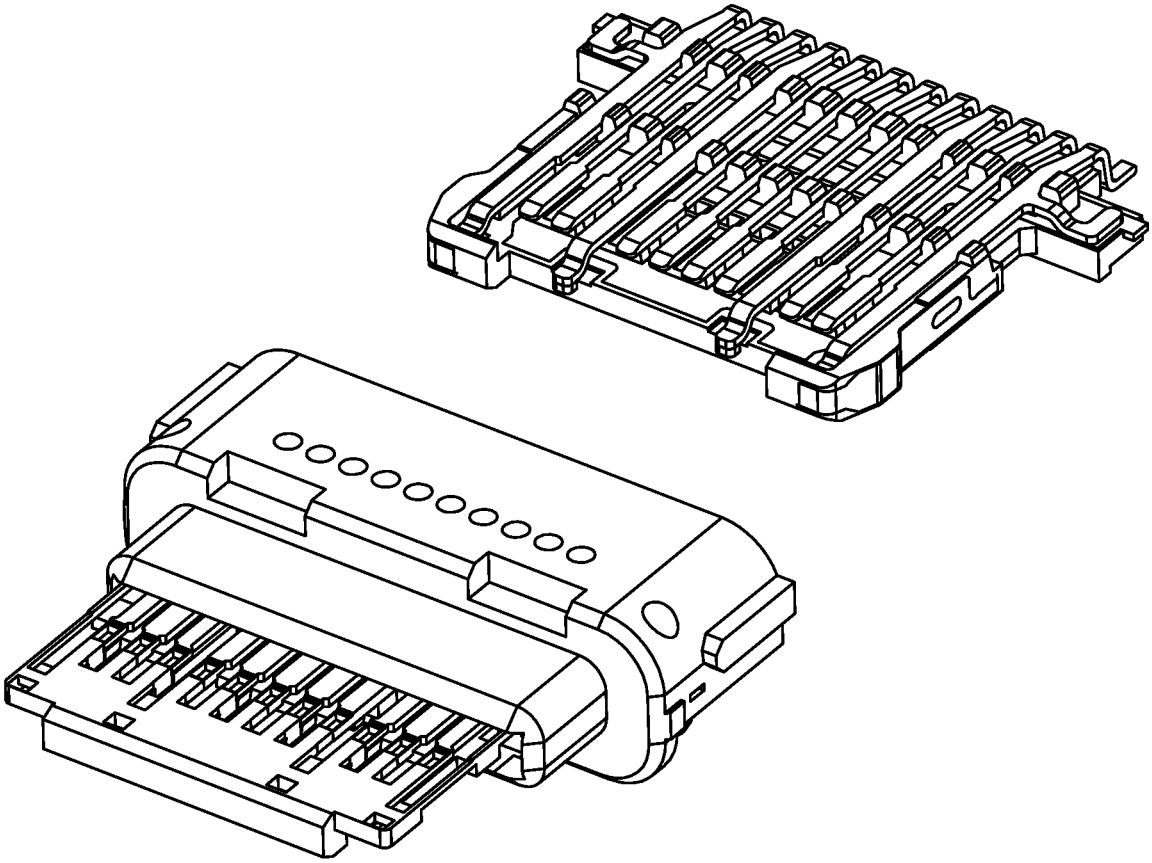
FIG. 22(A) is an exploded perspective view of the contact module of the electrical connector of FIG. 20.
Figure 22B:
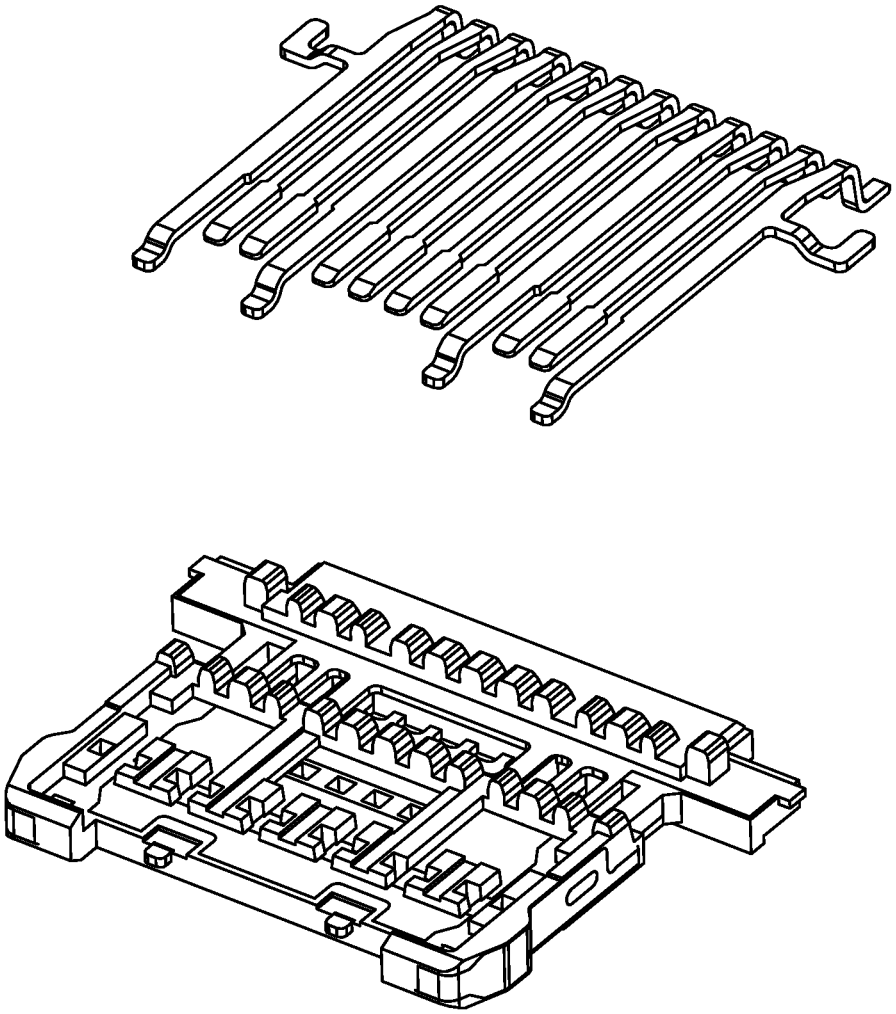
FIG. 22(B) is a further exploded perspective view of the contact module of the electrical connector of FIG. 23 without the second insulator thereof.
Figure 23A:
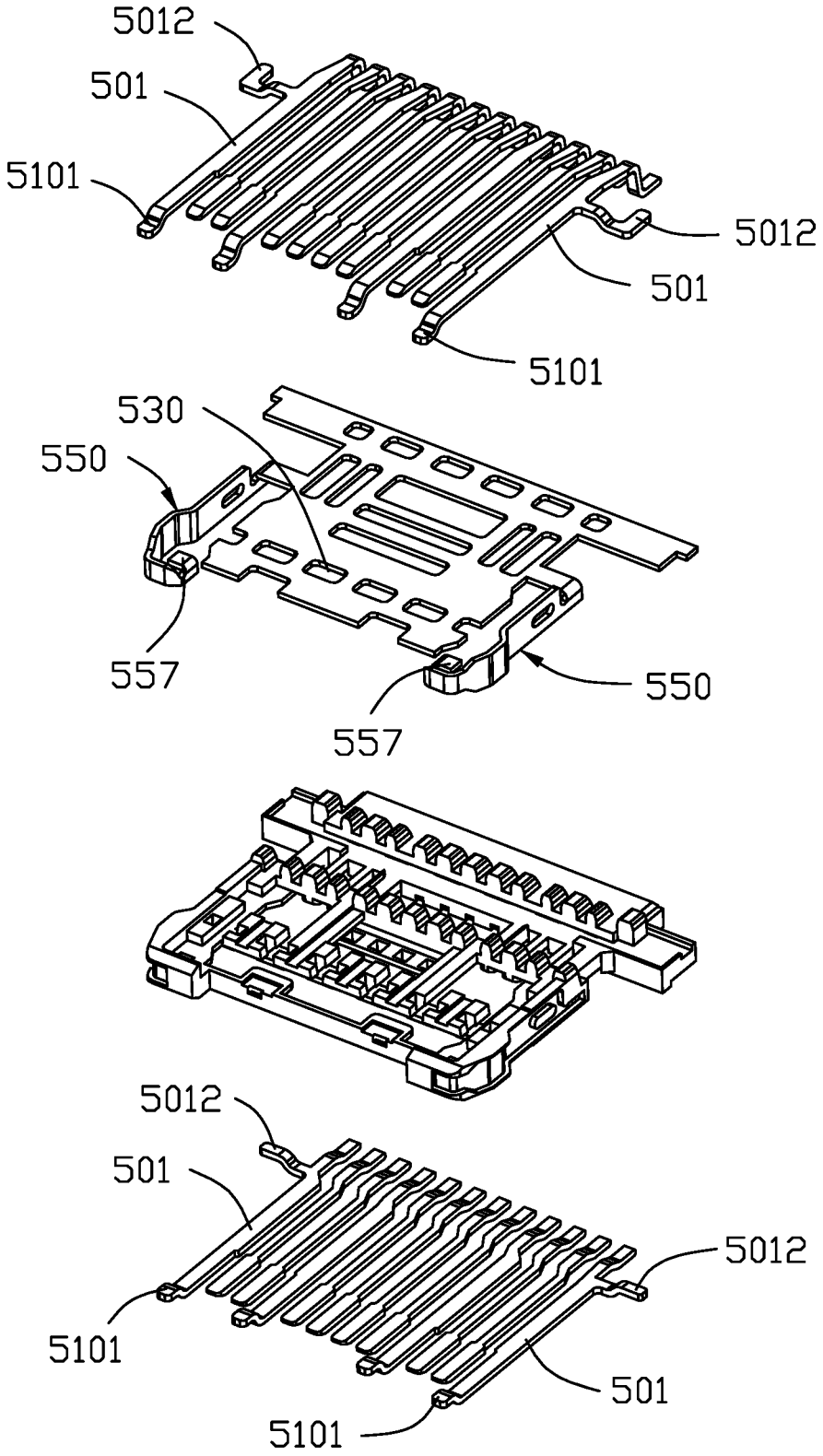
FIG. 23(A) is a further exploded perspective view of the contact module of the electrical connector of FIG. 22(B) without the second insulator thereof.
Figure 23B:
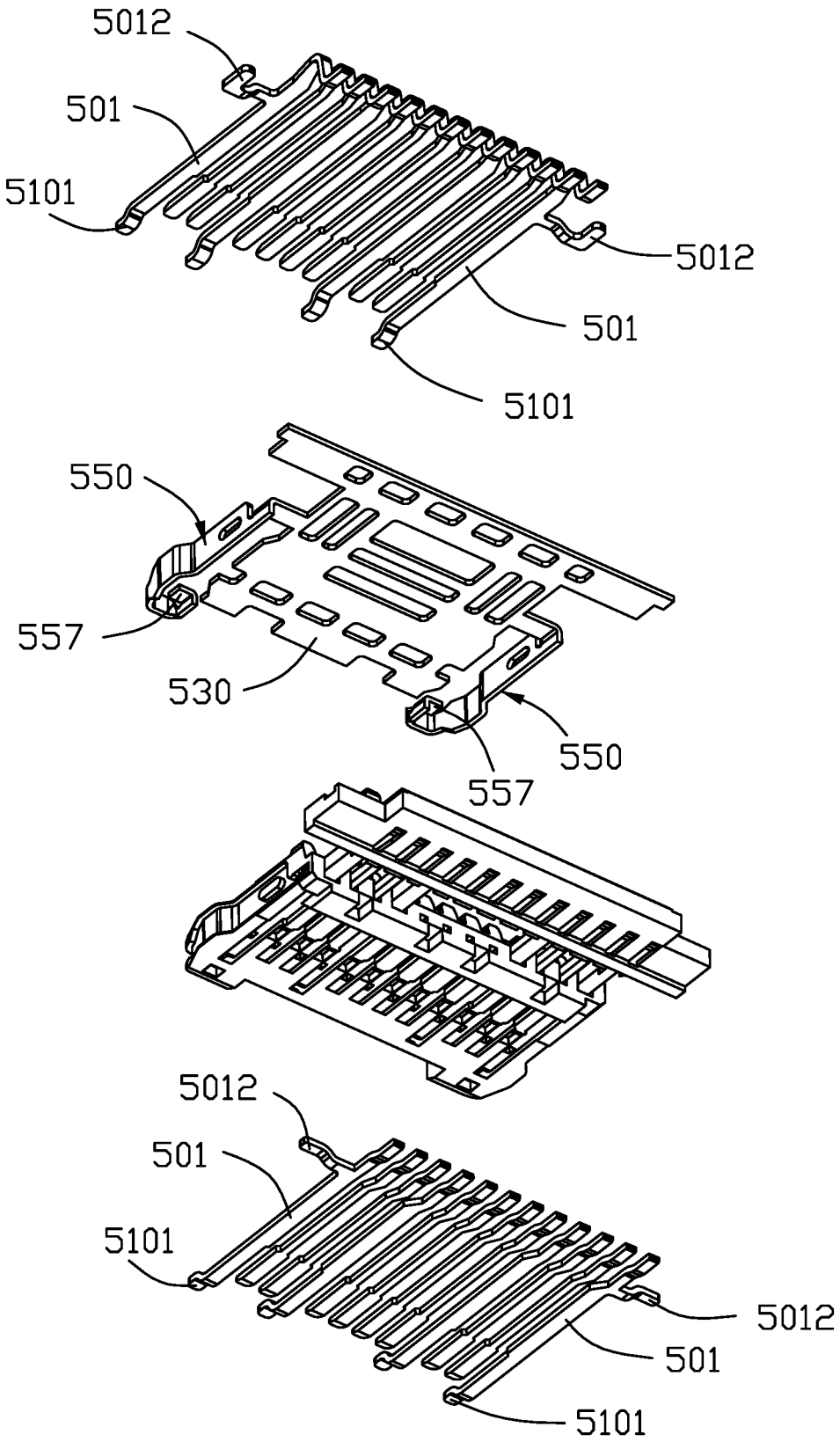
FIG. 23(B) is another further exploded perspective view of the contact module of the electrical connector of FIG. 22(B) without the second insulator thereof.
Figure 24:
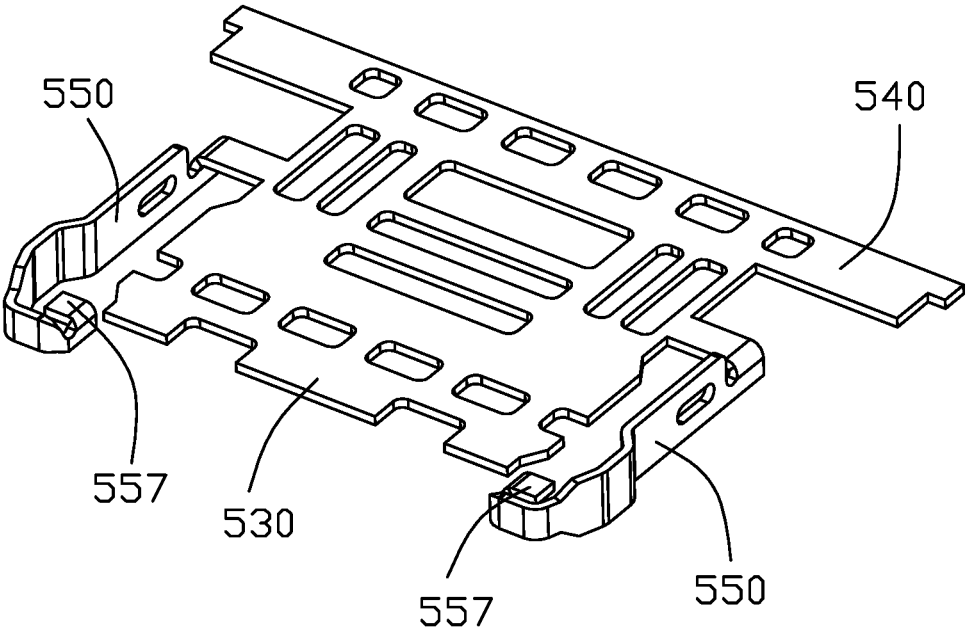
FIG. 24 is a perspective view of the shielding plate with the pair of locking arms and the associated transverse bar of the contact module of the electrical connector of FIG. 23(B).

FIGS. 20-24 show an electrical connector 400 according to the third embodiment. The basic structure and the assembling process of the electrical connector 400 is similar to those of the electrical connectors 100 or 300 except that each locking arm 50 extends from a rear area of the lateral side edge of the shielding plate 550 instead of from the transverse bar taught by the electrical connector 100 or from the front edge of the shielding plate taught by the electrical connector 300 wherein the horizontal part 557 of the front end of each locking arm 550 is sandwiched between the front ends 5101 of the corresponding upper grounding terminal 501 and lower grounding terminal 501 as well as that in the electrical connector 100. In other words, the horizontal part 557 intimately electrically and mechanically contacts the front ends 5101 of the corresponding upper grounding terminal 501 and lower grounding terminal 501. Notably, similar to the locking arm 50 in the electrical connector 100 and the locking arm 350 in the electrical connector 300, in the electrical connector 500 each locking arm 550 is essentially spaced from the corresponding lateral side edge of the shielding plate 530 for easing forming/bending the locking arm 550 thereof. Similar to the other two embodiments, the side end 5012 of the grounding terminal 501 abuts against the transverse bar 540.

The common feature of the three abovementioned embodiments is to provide the locking engagement region of the locking arm on the lateral side edge of the front mating region of the tongue portion in front of the rear step region wherein the locking engagement region provides an outwardly/laterally facing engagement surface with a dimension similar to the thickness of the front mating region of the tongue portion in the vertical direction, and the thickness direction of the locking engagement region extends horizontally that is different from the locking engagement region provided by the side edge of the shielding plate of the traditional receptacle connector defined in the committee specification.

Figure 25:
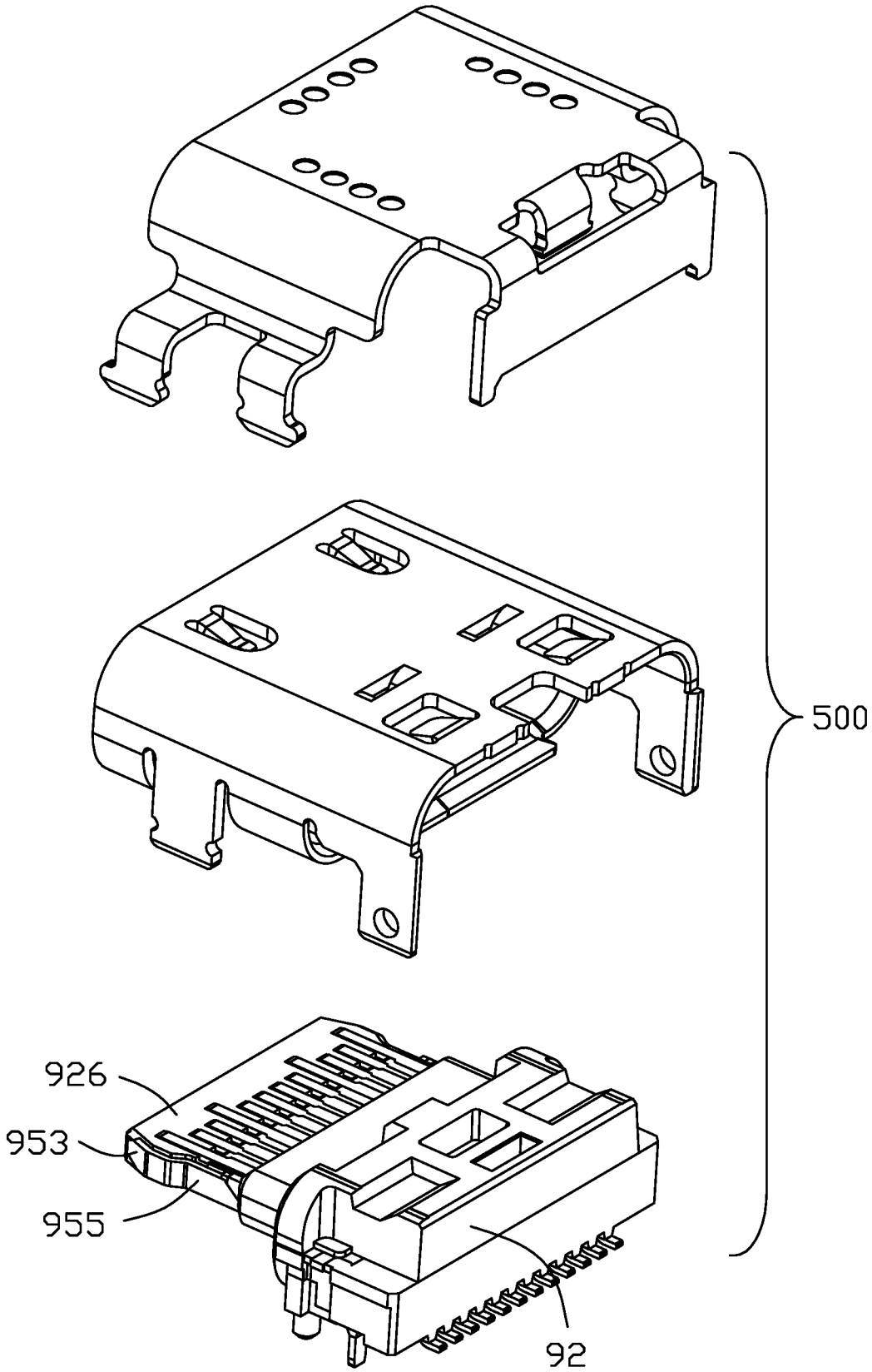
FIG. 25 is a rear downward exploded perspective view of the electrical connector according to a fourth embodiment of the invention.
Figure 26A:
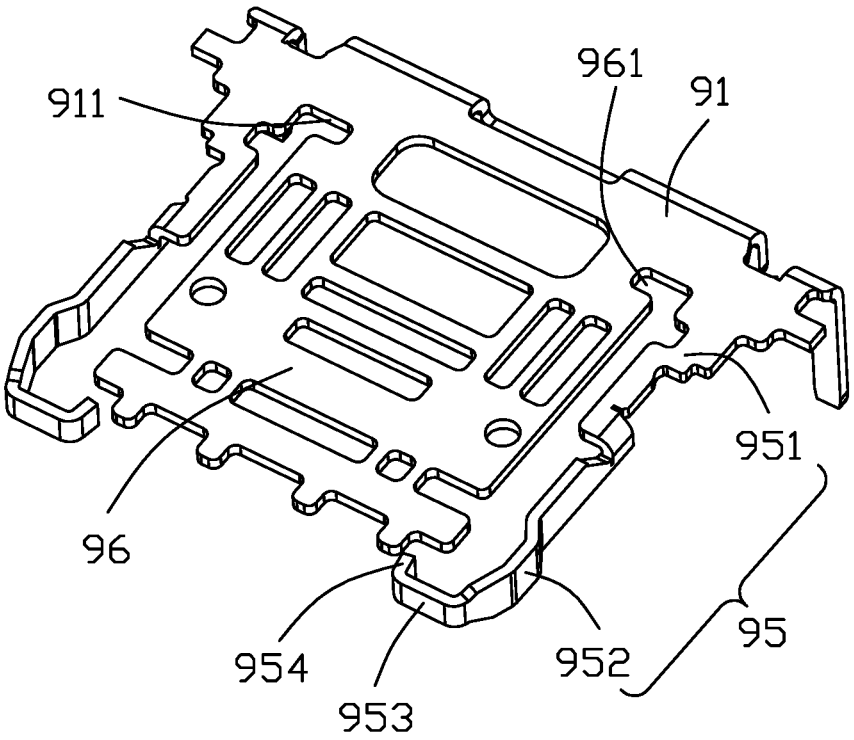
FIG. 26(A) is a font downward perspective view of the shielding plate with the pair of locking arms and the associated transverse bar of the contact module of the electrical connector of FIG. 25.
Figure 26B:
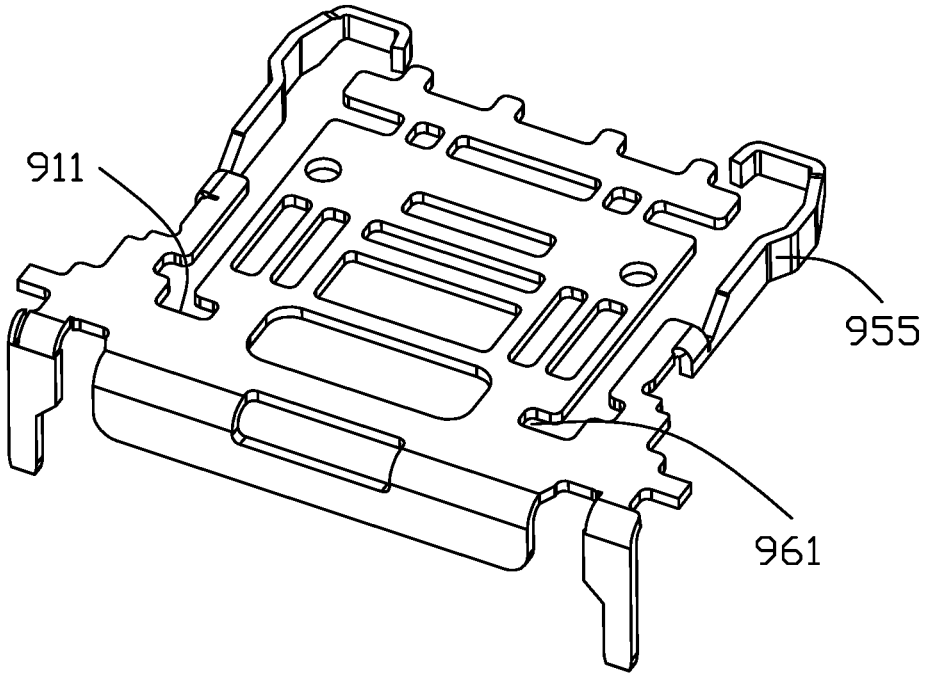
FIG. 26(B) is a rear downward perspective view of the shielding plate with the pair of locking arms and the associated transverse bar of the contact module of the electrical connector of FIG. 25.
Figure 27:
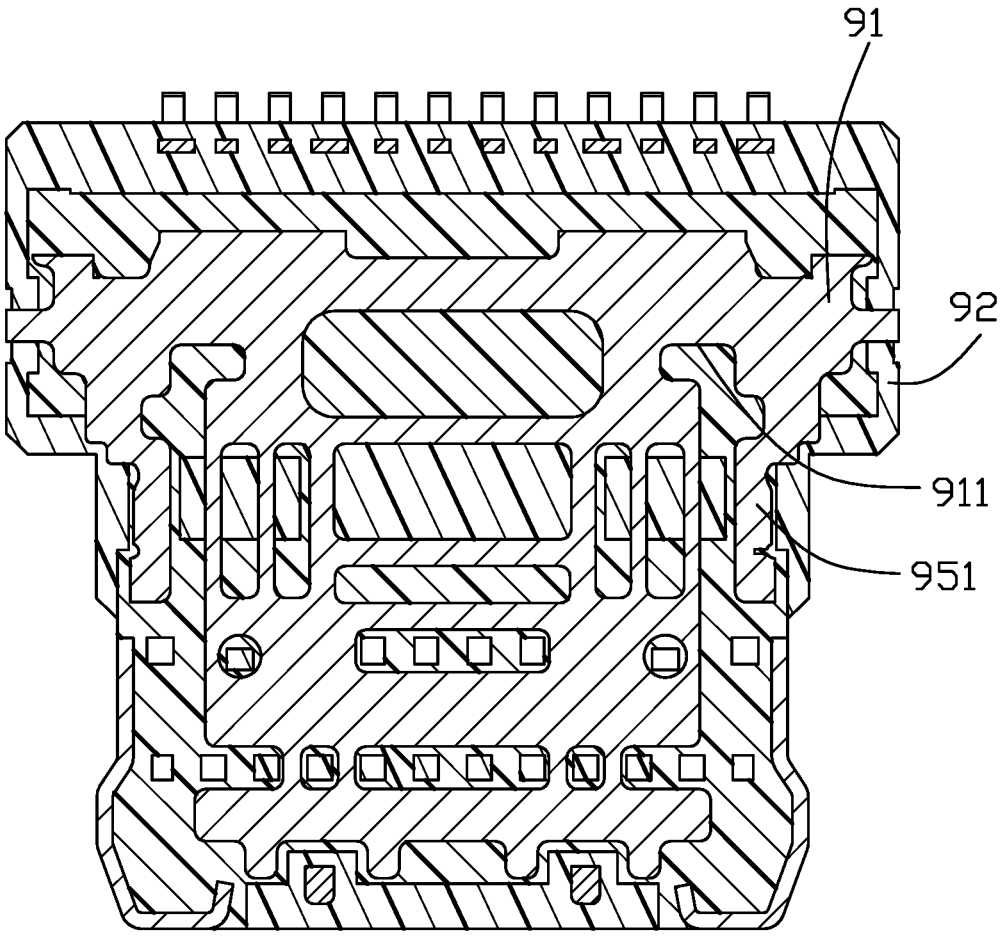
FIG. 27 is a cross-sectional view of the contact module of the electrical connector of FIG. 25.
Figure 28:
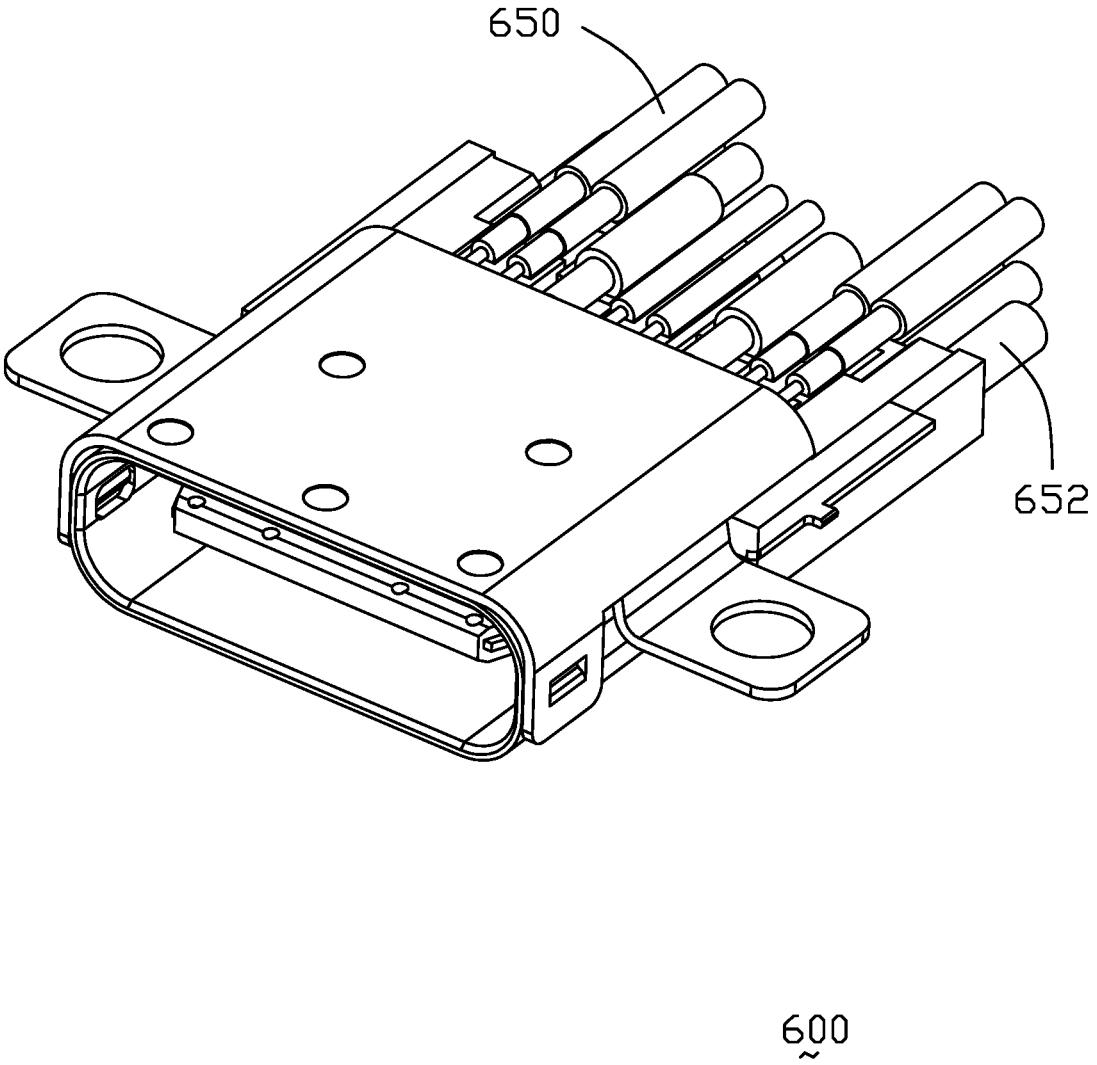
FIG. 28 is a front downward perspective view of the electrical connector according to a fifth embodiment of the invention.

FIGS. 25-28 show an electrical connector 500 according to the fourth embodiment. The basic structure and the assembling process of the electrical connector 500 is similar to those of the electrical connectors 100 except that each locking arm 95. The transverse bar 91 is still embedded in the base 92 and the locking arms includes an a rear horizontal portion 951 extending from a front edge 911 of the transverse bar 91 and a front vertical portion 952 continuing from the horizontal portion 951, each vertical portion 952 bends from an outer side of horizontal portion 951 and defines a out-protruding locking portion 955. The front end 953 of the vertical portion 952 go through the two opposite lateral sides and a front edge of the mating tongue, thereby forming a guiding performance. The rear end 951 of the vertical portion is embedded in the mating tongue. The locking arms extend horizontally and then vertically, so that the torsion of the vertical portion 952 is reduced. A cutout 961 is defined at a root of the locking arms, to enlarger the space between the locking arms and the shielding plate.

Figure 29:
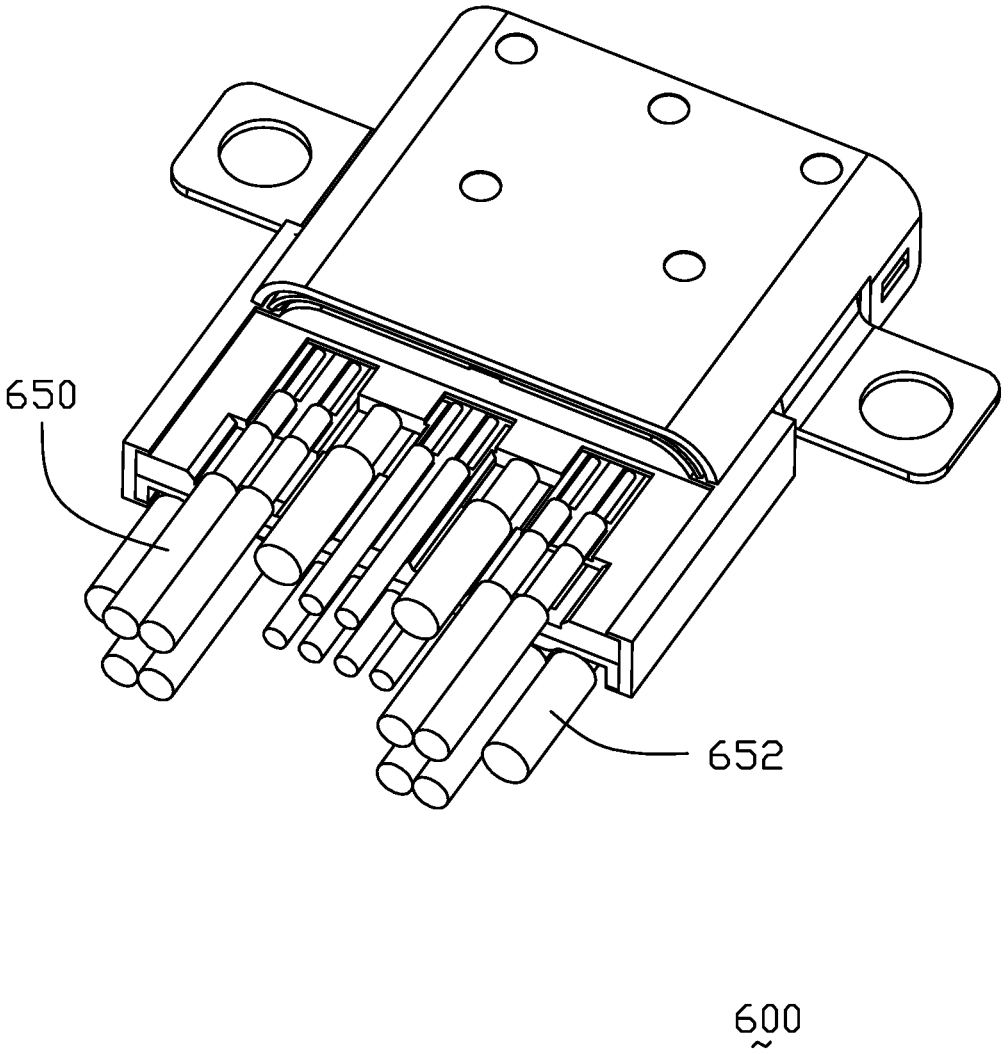
FIG. 29 is a rear downward perspective view of the electrical connector of FIG. 28.
Figure 30:
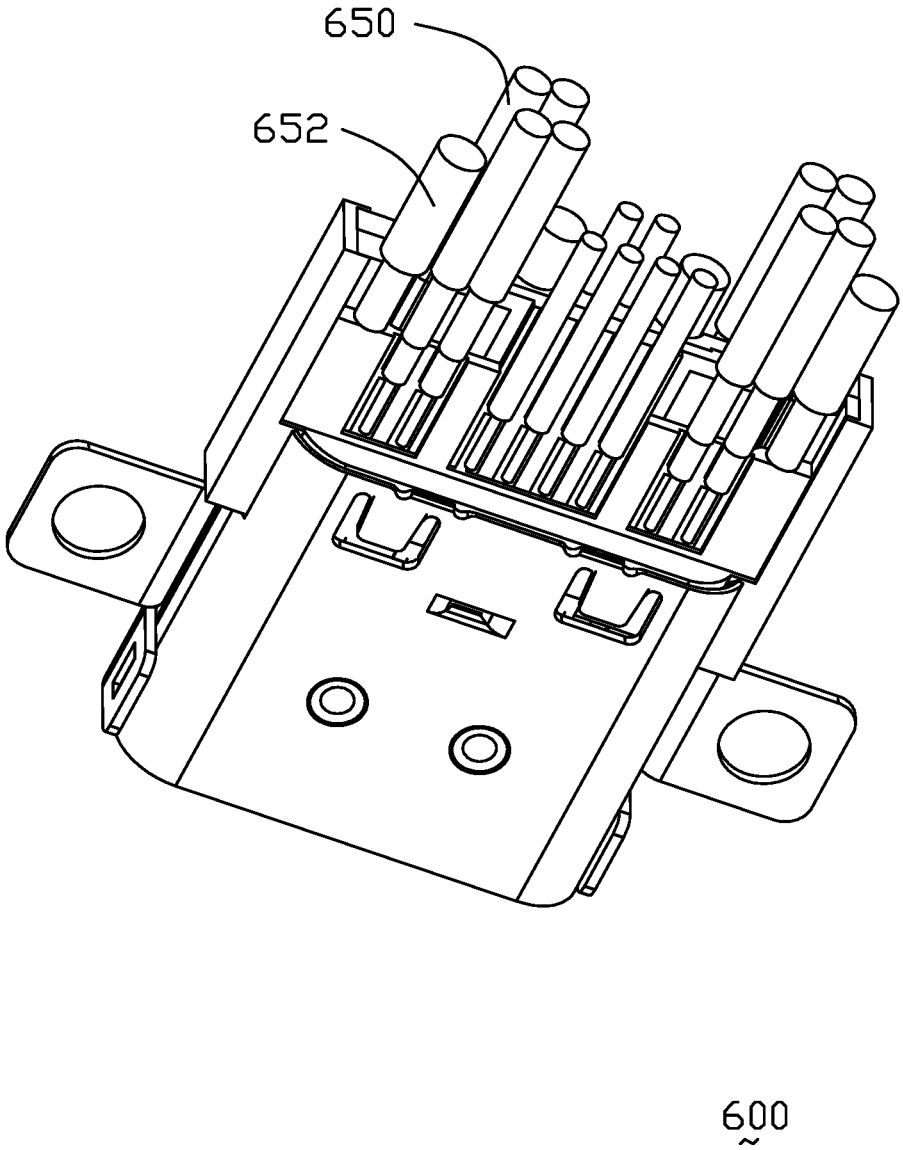
FIG. 30 is a rear upward perspective view of the electrical connector of FIG. 28.
Figure 31:
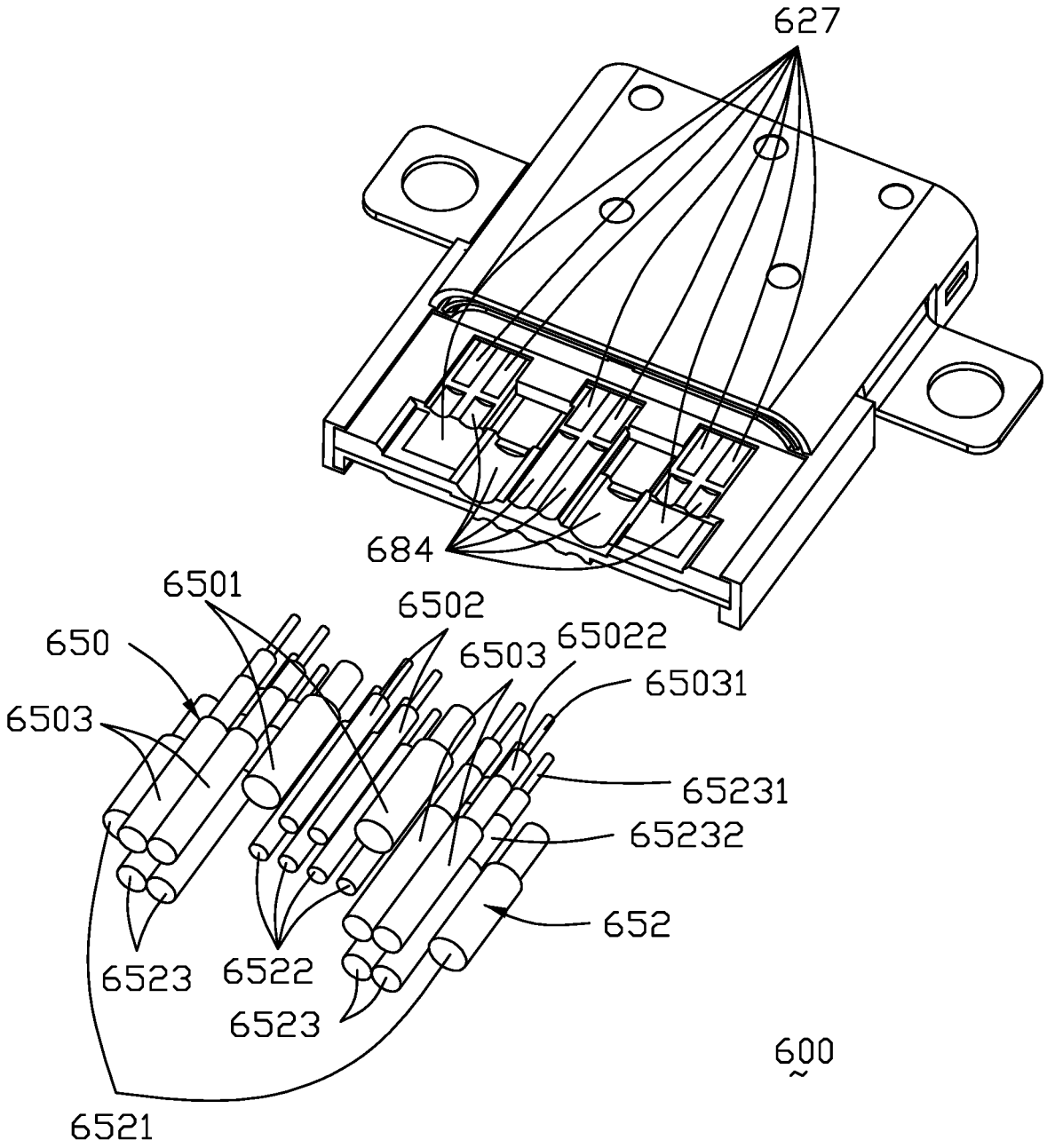
FIG. 31 is a rear downward exploded perspective view of the electrical connector of FIG. 28.
Figure 32:
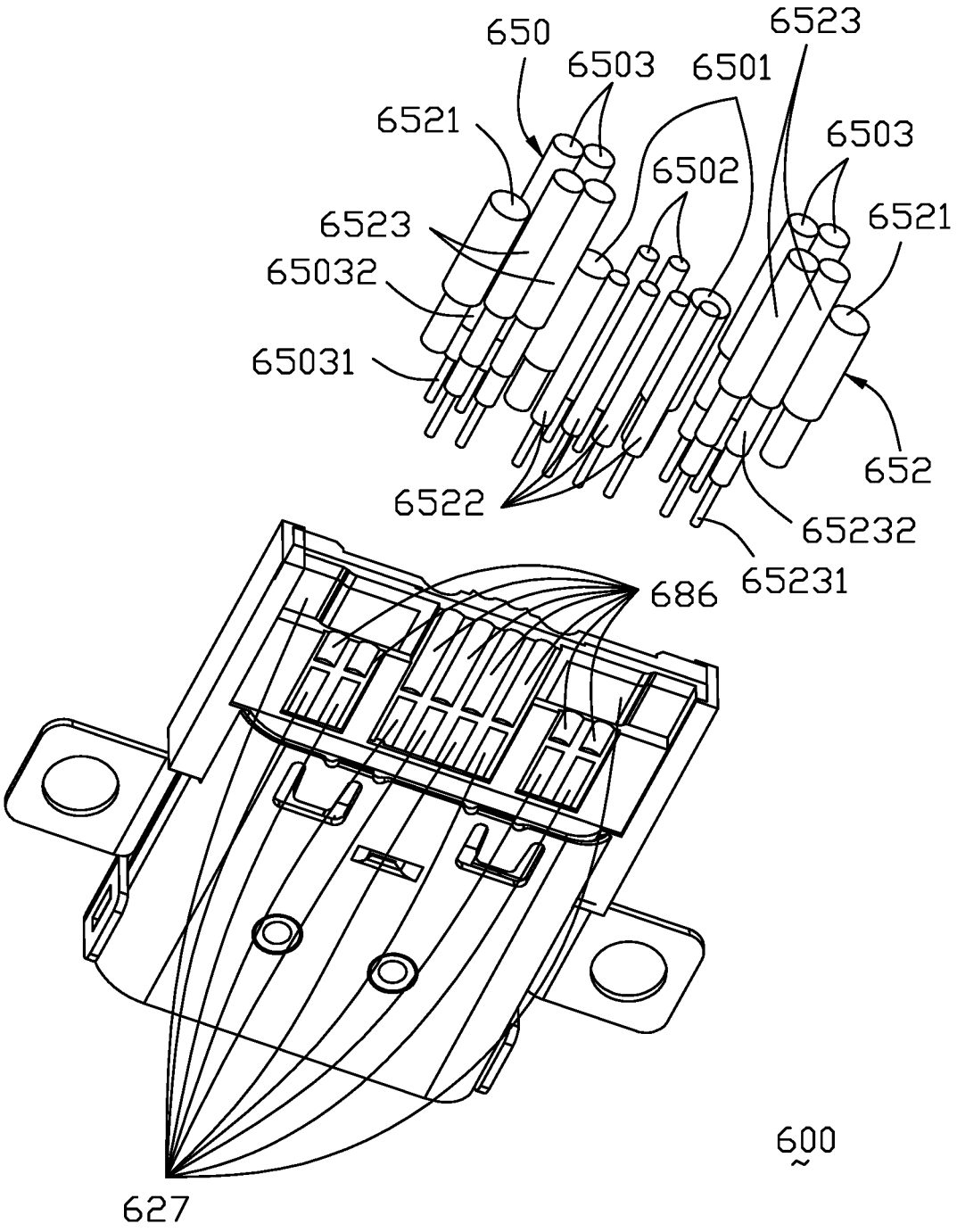
FIG. 32 is a rear upward exploded perspective view of the electrical connector of FIG. 28.
Figure 33:
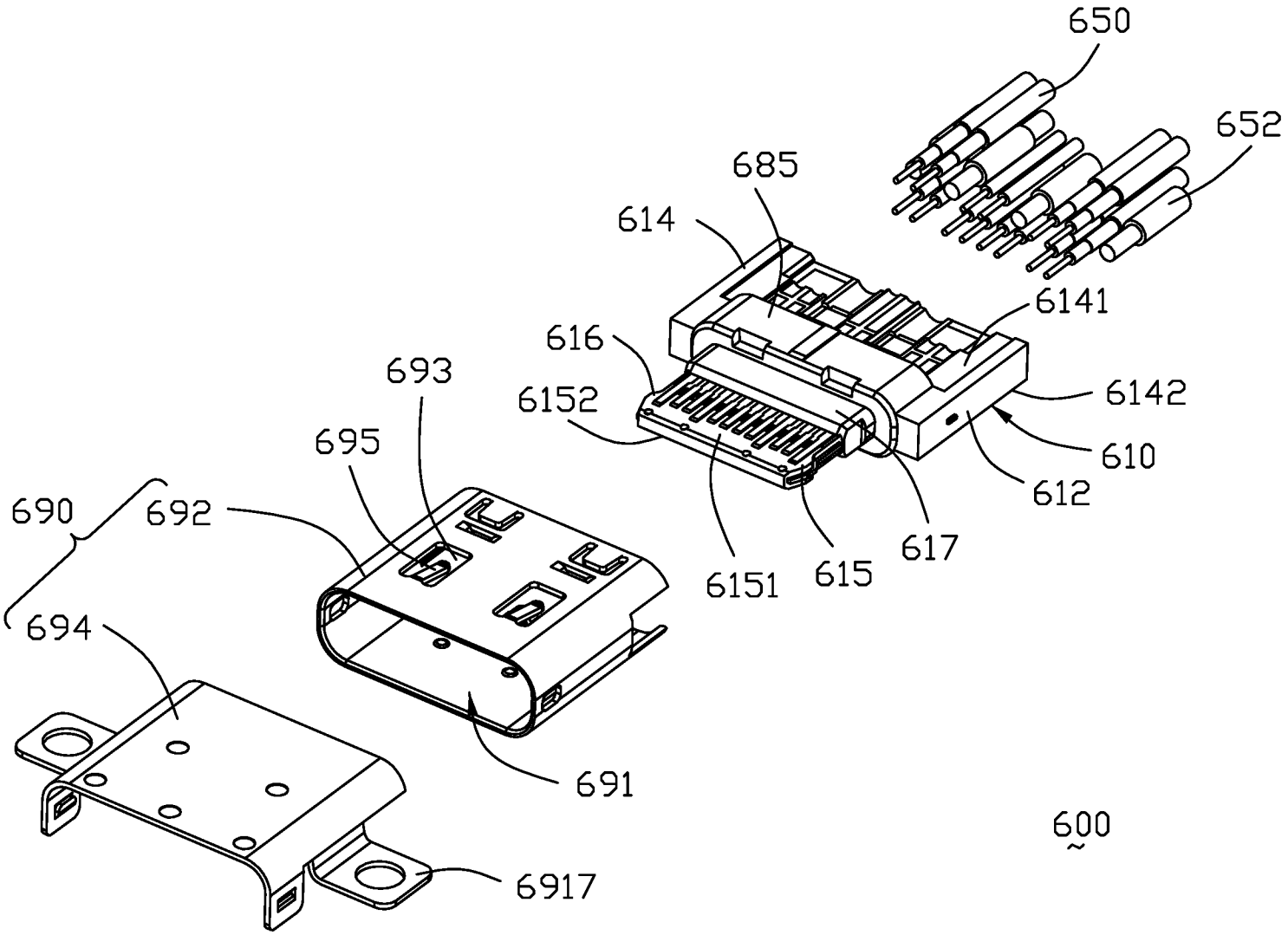
FIG. 33 is a further front exploded perspective view of the electrical connector of FIG. 31.
Figure 34:
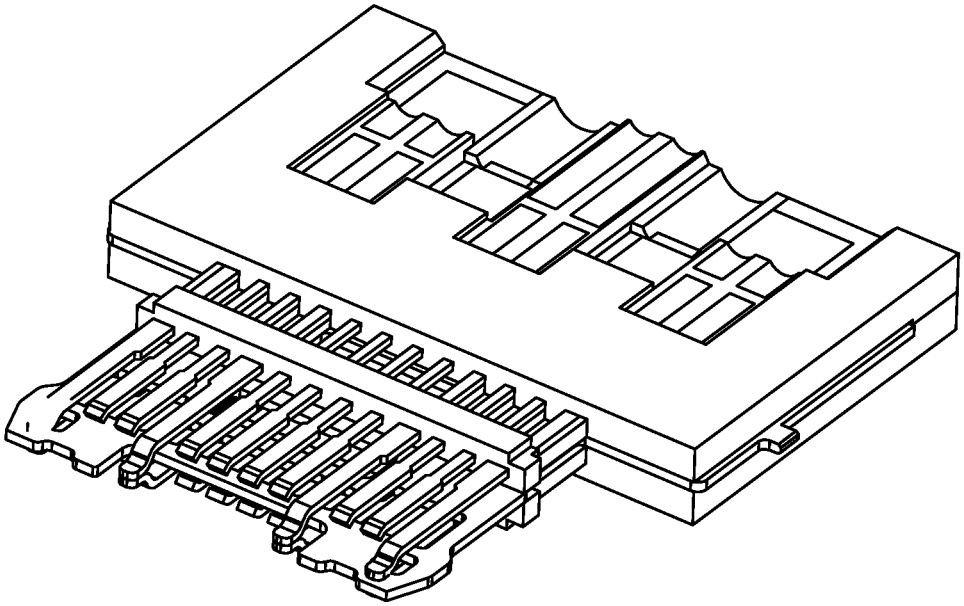
FIG. 34 is a front perspective view of the contact module of the electrical connector of FIG. 33 without the third insulator thereof.
Figure 35:
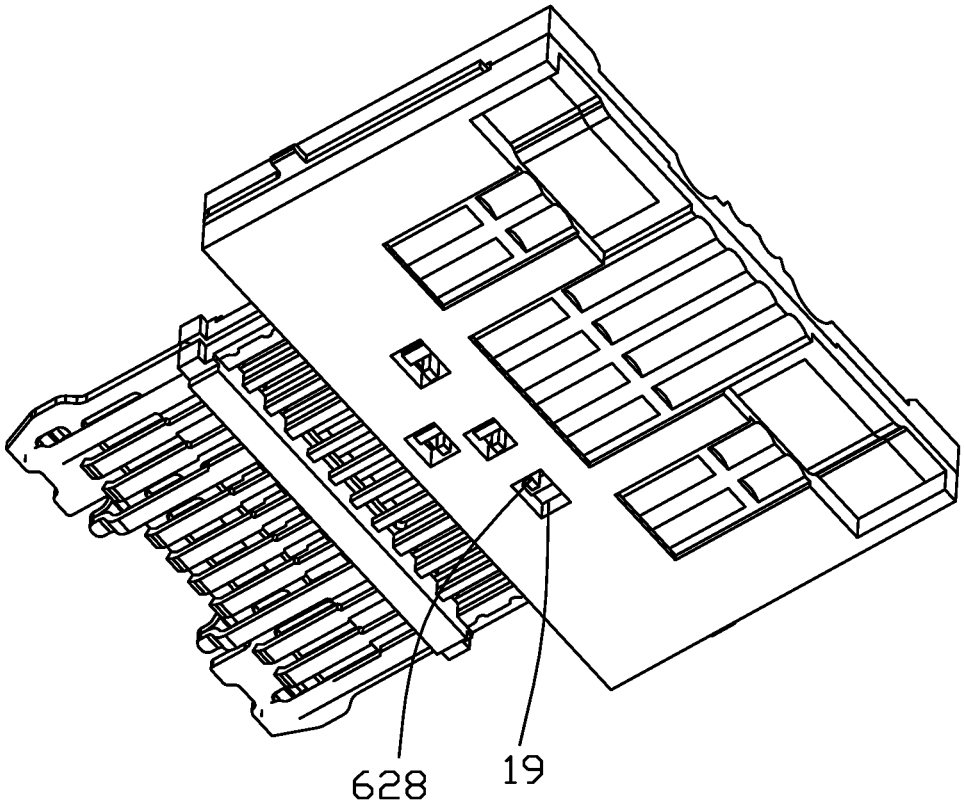
FIG. 35 is a rear perspective view of the contact module of the electrical connector of FIG. 33 without the third insulator thereof.
Figure 36:
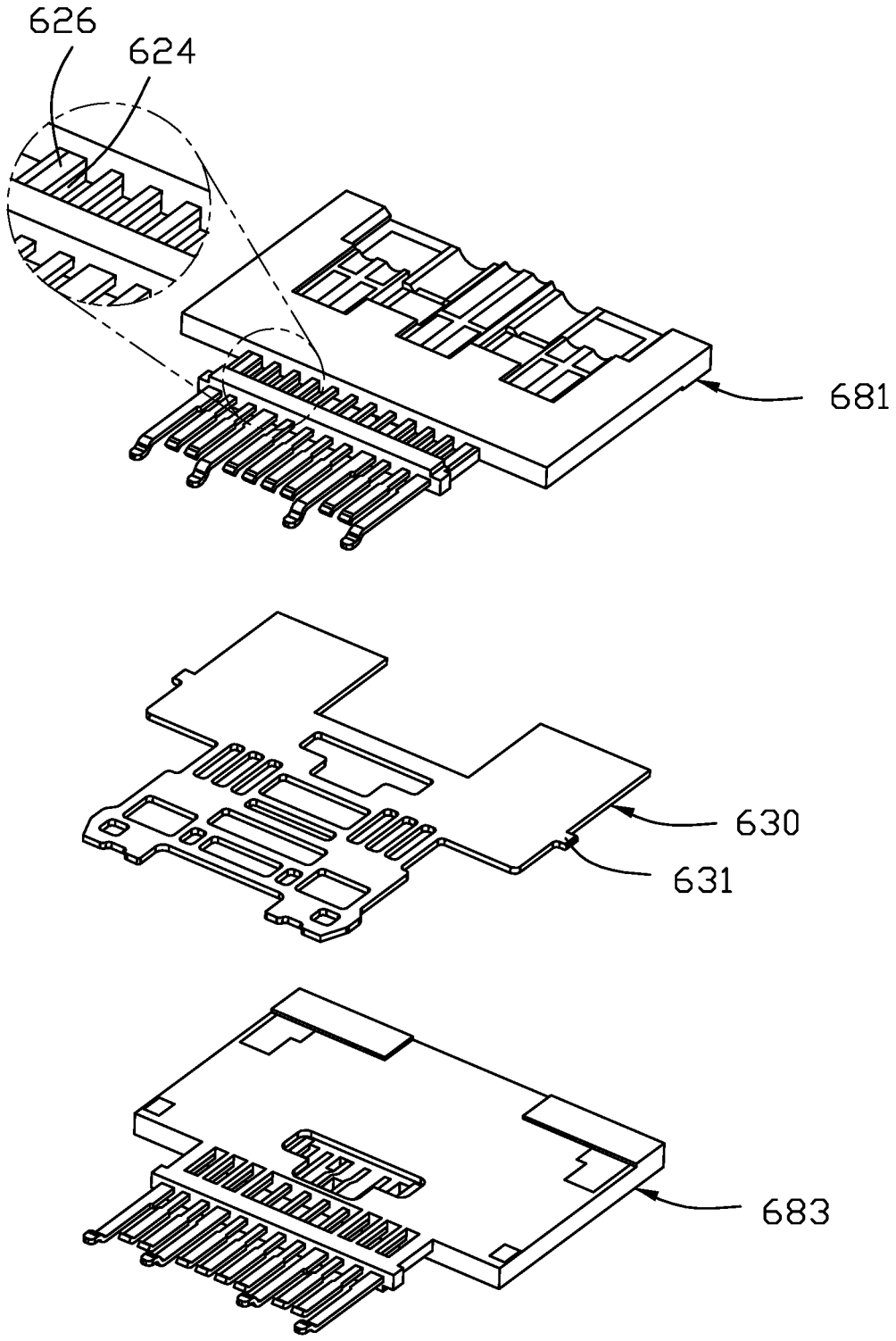
FIG. 36 is a front downward exploded perspective view of the contact module of the electrical connector of FIG. 34.
Figure 37:
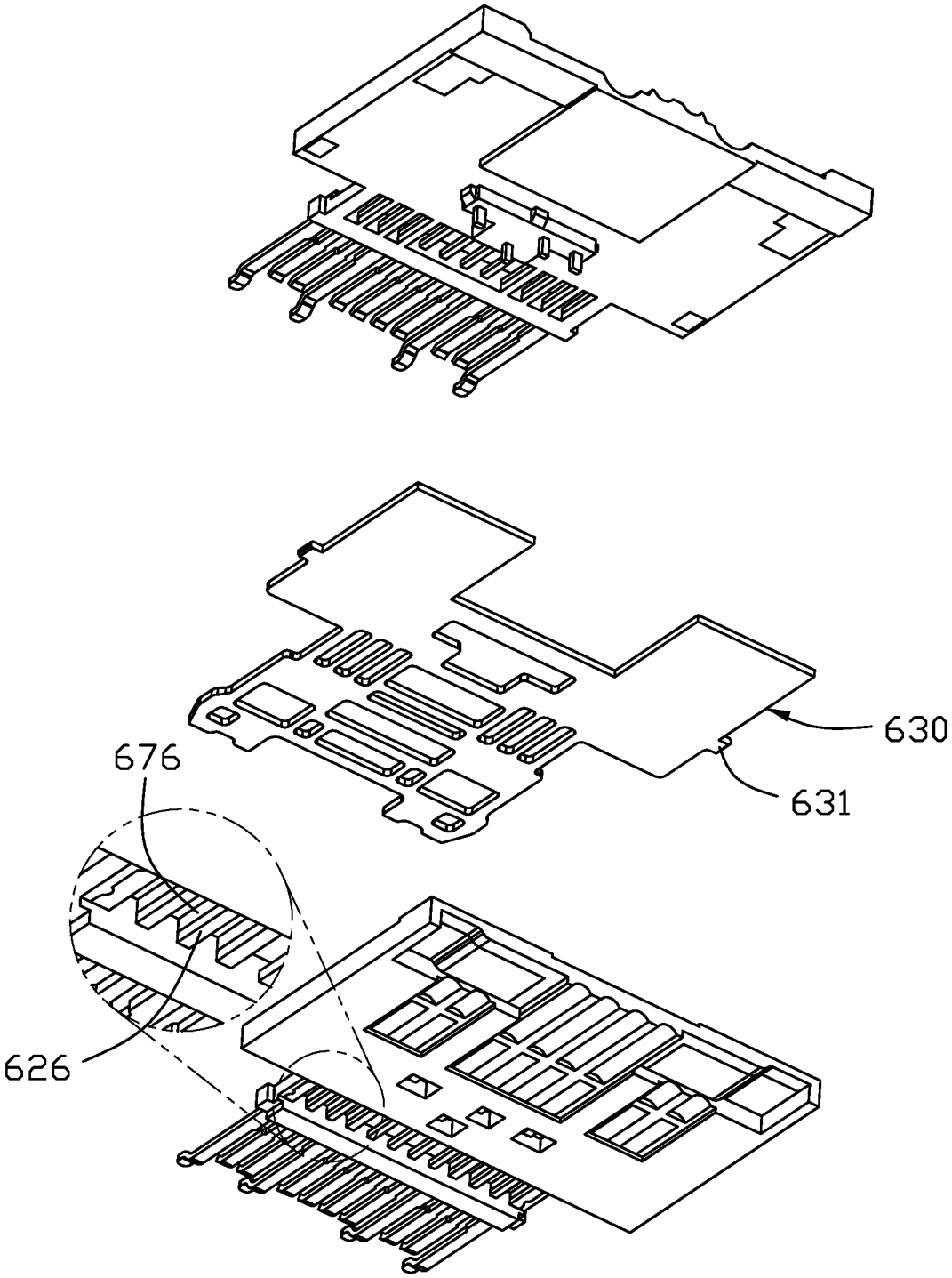
FIG. 37 is a rear upward exploded perspective view of the contact module of the electrical connector of FIG. 35.
Figure 38:
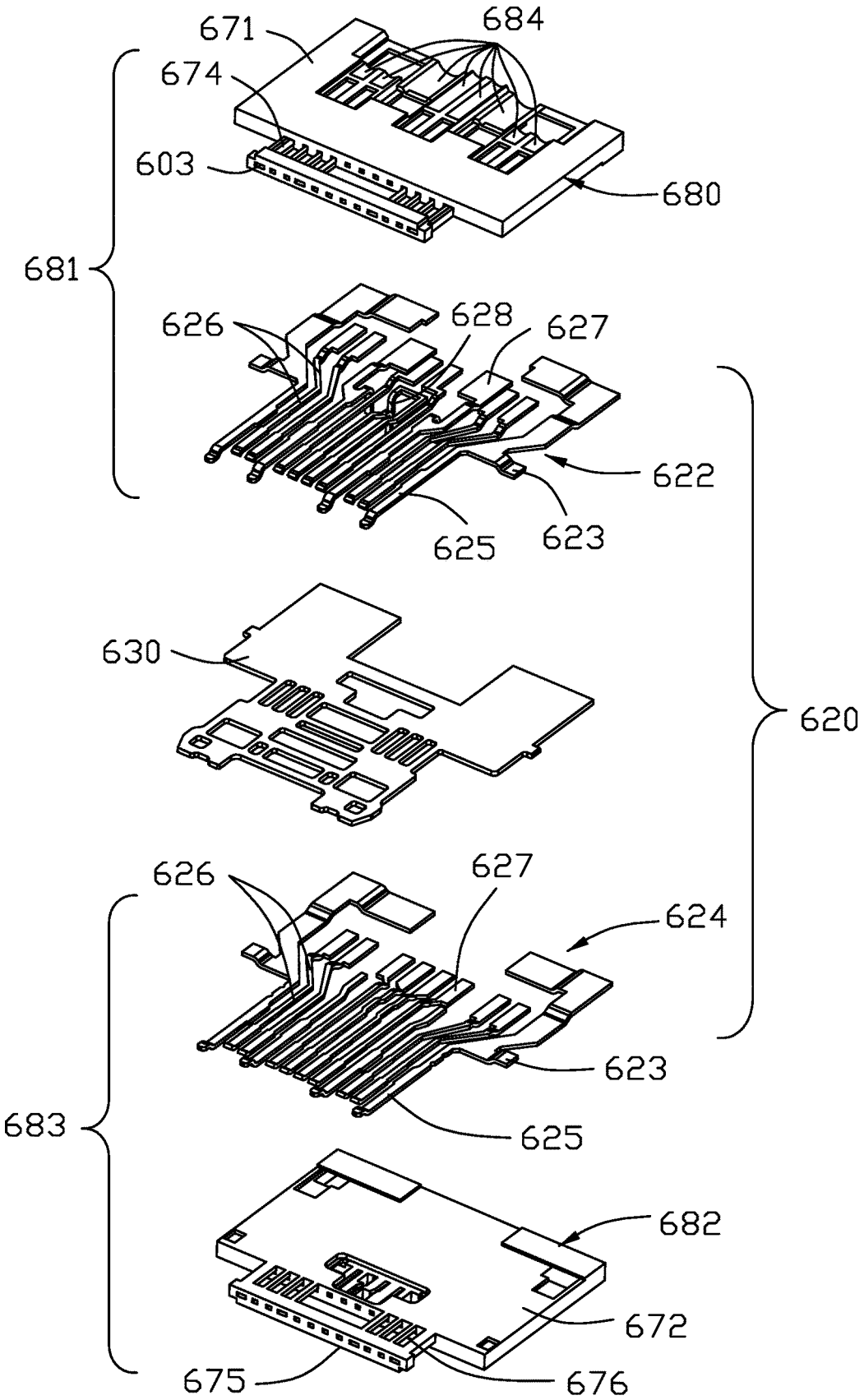
FIG. 38 is a front downward further exploded perspective view of the contact module of the electrical connector of FIG. 36.
Figure 39:
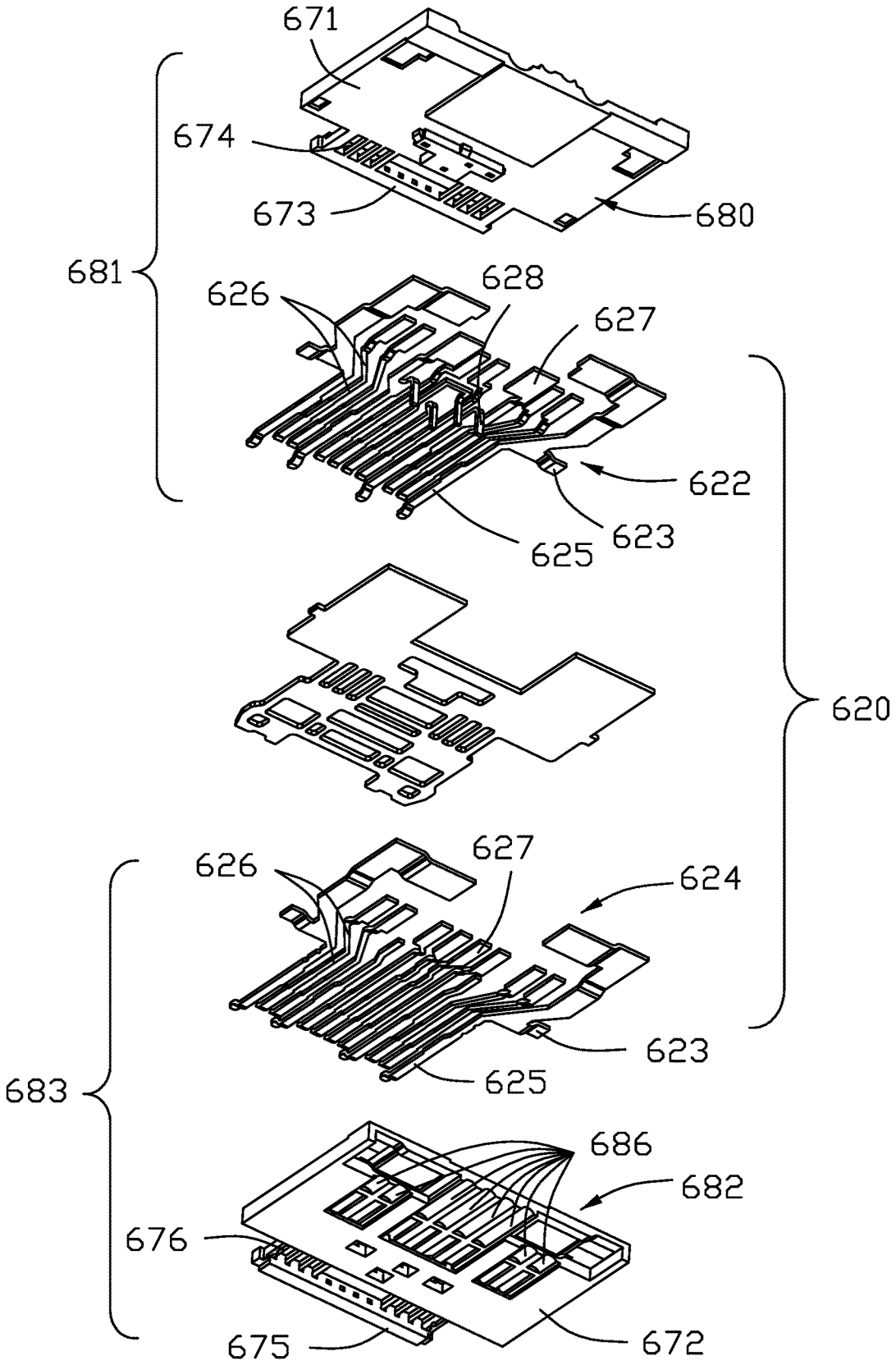
FIG. 39 is a rear upward further exploded perspective view of the contact module of the electrical connector of FIG. 37.
Figure 40A:
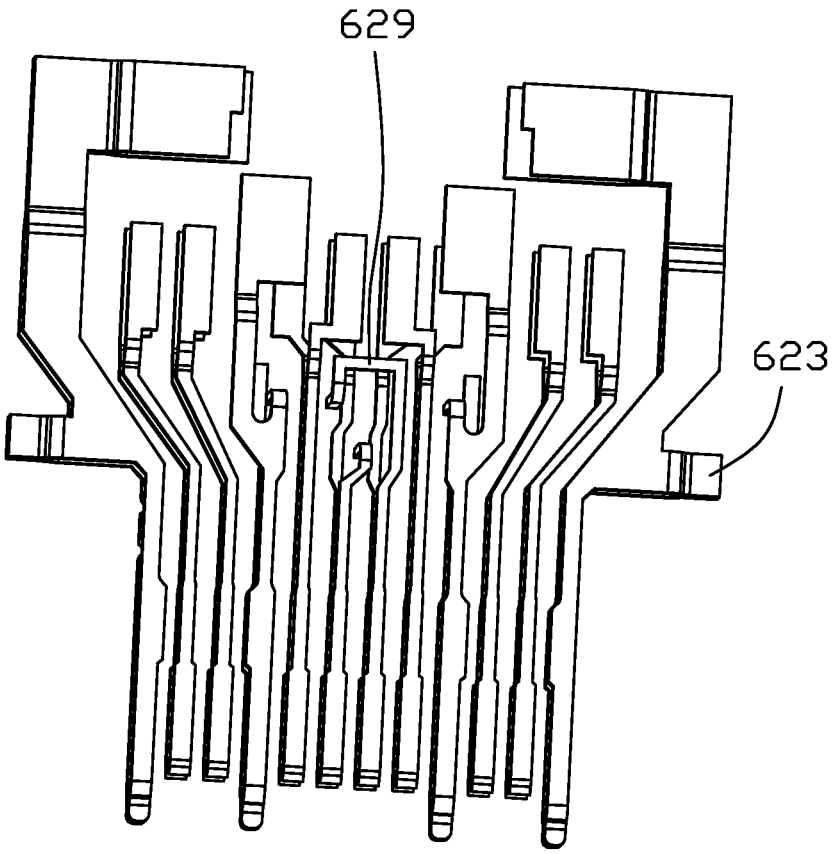
FIG. 40(A) is a top view of the two rows of terminals of the electrical connector of FIG. 28.
Figure 40B:
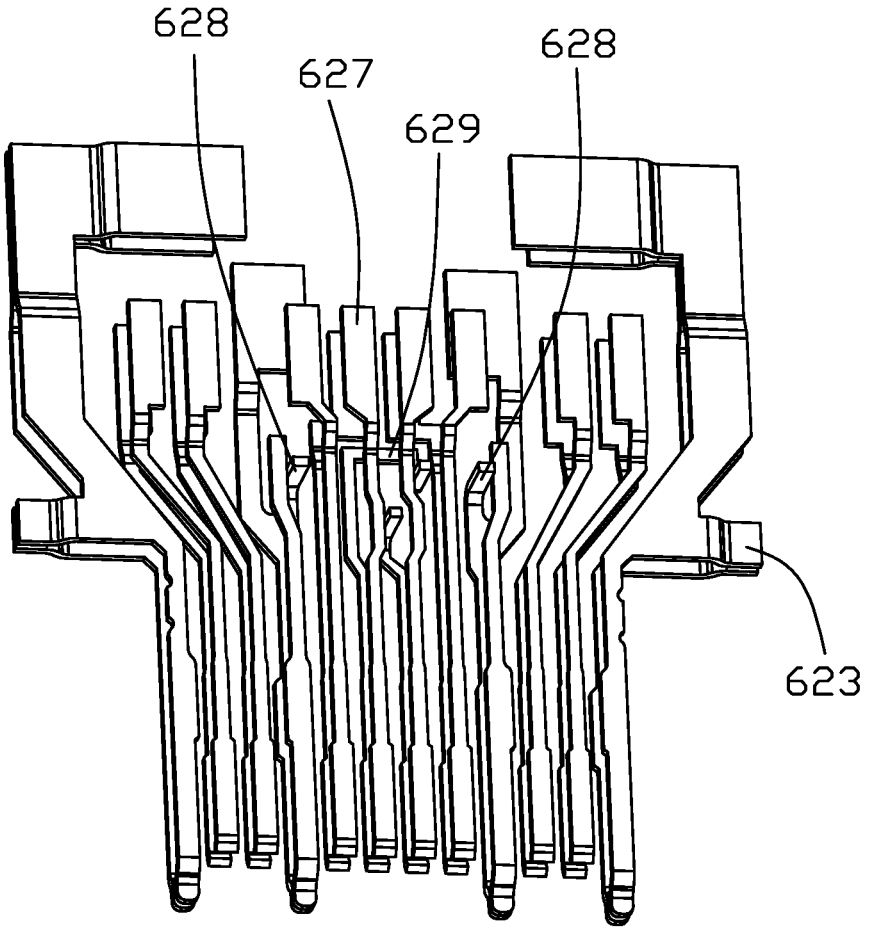
FIG. 40(B) is a bottom view of the two rows of terminals of the electrical connector of FIG. 28.
Figure 41:
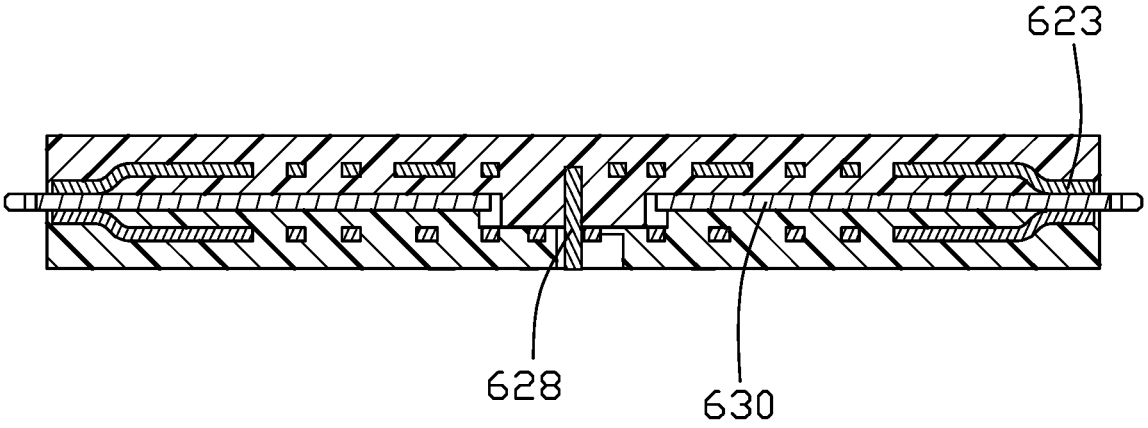
FIG. 41 is a cross-section view of the contact module of the electrical connector of FIG. 34 to show the upper terminal transmitting the D+ signal physically connects to the lower terminal transmitting the D+ signal.
Figure 42:
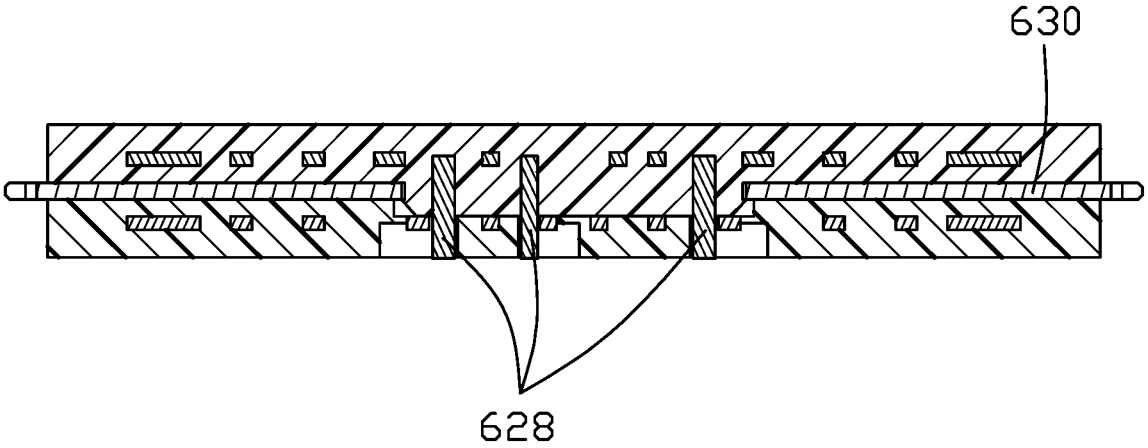
FIG. 42 is another cross-section view of the contact module of the electrical connector of FIG. 34 to show the upper terminal transmitting the D− signal physically connects to the lower terminal transmitting the D− signal, the upper terminals transmitting the power connect to the corresponding lower terminals transmitting the power.

Similarly, FIGS. 28-42 also disclose the USB Type C receptacle connector 600 except that the terminals are connected to the corresponding wires rather than mounting to the printed circuit board. Understandably, Notably, the receptacle mounted upon the printed circuit board may take advantage of having the simplified circuits by the printed circuit board for further connection. Anyhow, connection via the printed circuit board may result in transmission loss. One feature of the invention is to arrange the tails of the corresponding terminals in a specific way so as to have the same characterized terminals integrated together with a common connection end for soldering to only one wire instead of to plural wires. In other words, the invention may have the advantage of using the printed circuit board without the drawback of using the printed circuit board.

The electrical connector 600 includes a contact module 610 enclosed within a shell body 690 with a mating cavity 691 therebetween for receiving the complementary plug connector therein. The shell body 690 has an inner shell 692 directly encloses the contact module 610, and an outer shell 694 attached upon the inner shell 692 to veil the openings 693 in the inner shell 692 in which the spring tangs 695 extend toward the mating cavity 691. The outer shell 694 forms a pair of mounting ears 697 on two lateral sides for mounting to an external device. In this embodiment, the pair of mounting ears 697 having the corresponding screw holes therein, are located at the same level with the mid-level of the mating region of the tongue portion illustrated later.

The contact module 610 includes an insulative housing 612 and a plurality of terminals 620 secured to the housing 612. The insulative housing 612 includes a base 614 and a tongue portion 616 extends forwardly from the base 614. The front tongue portion 616 includes a front mating region 615 and a rear step region 617. The front mating region 615 forms two opposite upper mating surface 6151 and lower mating surface 6152. The base 614 forms opposite upper connecting surface 6141 and lower connecting surface 6142.

The terminals 620 includes a plurality of upper terminals 622 and a plurality of lower terminals 624, The twelve upper terminals 622 are arranged with one another along the transverse direction as well as the lower terminals 624. The twelve upper terminals 622 are categorized with, in sequence, ground, high speed differential pair (TX1+, TX1−), power, CC1, low speed differential pair (D+, D−), SBU1, power, high speed differential pair (RX1−, RX1+) and ground in the transverse direction. The twelve lower terminals 624 are arranged with the upper terminals 622 in a reversely symmetric manner in the vertical direction and categorized with, in sequence, ground, high speed differential pair (RX2+, RX2−), power, SBU2, low speed differential pair (D−, D+), CC2, power, high speed differential pair (TX2−, TX2+), ground. Each of most terminal 620 except the low speed differential pair of the upper terminals 622 and the powers of the lower terminals 624, has a front mating section 625, a rear connecting section 627 and a middle retaining section 626 along the front-to-back direction. Being without the corresponding connecting sections 627, the low speed differential pair (D+, D−) of the upper terminals 622 form the corresponding downwardly extending legs 628 so as to sideward contact the corresponding low speed differential pair (D+, D−) of the lower terminals 624. Similarly, the power terminals of the upper terminals 622 further include the corresponding downwardly extending legs 628 to sideward contact the corresponding power terminals of the lower terminals 624. Notably, the connecting sections 627 are spanned in essentially a fanned-out manner compared with the fine pitch front contacting section 625 for complying with the diameters of the corresponding wires (illustrated later).

The upper terminals 622 are integrally formed with a first/upper insulator 680 as a first sub-assembly 681 via an insert-molding process, and the lower terminals 624 are integrally formed with a second/lower insulator 682 as a second sub-assembly 683 via another insert-molding process. A metallic shielding plate 630 is sandwiched between the first sub-assembly 681 and the second sub-assembly 683 in the vertical direction. The connecting sections 627 of the upper terminals 622 are exposed upon the upside surface of the first insulator 680, and a plurality of first grooves 684 are formed in the upside surface of the main body 671 of the first insulator 680. The connecting sections 627 of the lower terminals 624 are exposed upon the underside surface of the second insulator 682, and a plurality of second grooves 686 are formed in the underside surface of the main body 672 of the second insulator 682. The first insulator 680 further includes a front bar 673 with a plurality of rods 674 to hold the retaining sections 626 of the upper terminals 622 for supporting. Similarly, the second insulator 682 further includes a front bar 675 with a plurality of rods 676 to hold the retaining sections 626 of the lower terminals 624 for supporting. The first sub-assembly 681 and the second sub-assembly 683 commonly sandwich the shielding plate 630 therebetween to form semi-assembly 688 and are further integrally formed with a third insulator 685 to form the complete contact module 610 via an additional insert-molding or over-molding process.

Eight upper wires 650 are respectively connected to the connecting sections 627 of the corresponding upper terminals 622, and ten lower wires 652 are respectively connected to the connecting sections 627 of the corresponding lower terminals 624. The eight upper wires 650 include two large size wires 6501 respectively connected to the power terminals, two small size wires 6502 respectively connected to CC1 and SBU1, and two pairs of middle size wires 6503 respectively connected to the high speed differential pairs wherein the middle size wire 6503 is of the coaxial wire including an inner connector 65031 connected to the corresponding connecting section 627 of the high speed differential pair, and an outer conductor 65032 connected to the connecting section 627 of the ground terminal. Similarly, the ten lower wires 652 include two large size wires 6521 respectively connected to the ground terminals, four small size wires 6522 respectively connected to SBU2, low speed differential pair and CC2, and two pairs of middle size wires 6523 respectively connected to the high speed differential pairs wherein the middle size wire 6523 is of a coaxial wire including an inner conductor 65231 connected to the corresponding connecting section 627 of the high speed differential pair, and an outer conductor 65232 connected to the corresponding connecting section 627 of the ground terminal. Understandably, except the coaxial wire having the inner conductor enclosed within the inner insulator which is enclosed in the outer conductor enclosed in the outer insulator, the single wire has an inner conductor enclosed within an insulator.

In this embodiment, because the low speed differential pair of the upper terminals 622 have no rear connecting sections 627 but with vacant space available thereabouts, the connecting sections 627 of CC1 and SBU1 of the upper terminals 622 are spanned in a converged manner to occupy such space behind the corresponding low speed differential pair of the upper terminals 622. Correspondingly, the connecting sections 627 of the upper power terminals requiring relatively large areas, may sideward extend to occupy the space behind the neighboring CC1 and SBU1. Similarly, because the lower power terminals have no connecting sections 627 but with vacant space available thereabouts, the connecting sections 627 of the CC2 and SBU2 of the lower terminals 624 may outwardly spanned to occupy such space behind the lower power terminals 624. Therefore, either the upside surface of the first insulator 680 and the underside of the lower insulator 682 may provide sufficient space for cooperating with the upper wires 650 or the lower wires 652, respectively.

Notably, the upper power terminal 622 has not only the rear connecting section 627 for connecting to the corresponding power wire, but also the corresponding leg 628 for connecting to the lower power terminal 624 which has no connecting section 627 for connecting to the power wire. Differently, the low speed differential pair of the upper terminals 622 have no connecting sections 627 but the legs 628 connecting to the corresponding low speed differential pair of the lower terminals 624 which have the connecting sections 627. In brief, in the invention via the extending legs, some upper terminals and lower terminals share the same connecting sections for connecting to the same wire, thus saving the corresponding connecting space and the corresponding wires, advantageously. Simultaneously, the saved space due to the aforementioned removed connecting sections 627 of the low speed differential pair of the upper terminals 622 may allow the requisitely enlarged connecting sections 627 of the neighboring upper power terminals 622 for complying with the large size power wires. Notably, different from that the leg 628 directly extends from the corresponding low speed differential pair (D+), the leg 628 is linked to the corresponding low speed differential pair (D−) via a cross beam 629. It is because the low speed differential pair of the upper terminals 622 and those of the lower terminals 624 are reversely or diagonally symmetric with each other rather than vertically symmetric with each other. Differently, the legs linking the corresponding upper and lower power terminals extends vertically without assistance of any cross beam.

The ground terminal has the side projection 623 abuts against the shielding plate 630 for grounding. The shielding plate 630 further includes two side projections 631 for retention with the housing 612. As understood, the contact module 610 is first assembled and successively assembled to the corresponding shell body 690, and the corresponding upper wires 650 and lower wires 652 are finally soldered upon the connecting sections 627 of the corresponding terminals 20, respectively. Notably, the base 14 forms a plurality of holes 19 in which the legs 628 extends for not only molding consideration and but also securing consideration by soldering the legs 628 to the corresponding connected terminals.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a shielding shell;

a contact module disposed in the shielding shell and including:

an insulative housing including a base and a tongue portion extending forwardly form the base in a front-to-back direction, the tongue portion forming opposite upper surface and lower surface in a vertical direction perpendicular to the front-to-back direction;

a metallic transverses bar embedded within the base;

a metallic shielding plate disposed in the tongue portion between the upper surface and the lower surface and linked to the transverse bar;

a plurality of upper terminals disposed in the insulative housing with corresponding contacting sections exposed upon the upper surface;

a plurality of lower terminals disposed in the insulative housing with corresponding contacting sections exposed upon the lower surface; and a pair of metallic locking arms extending from two opposite front edges of the transverse bar and attached upon two opposite lateral side edges of the tongue portion;

wherein each locking arm has a locking engagement region with an outwardly and laterally facing engagement surface which is dimensioned similar to a thickness of the tongue portion in the vertical direction, and a thickness direction of said locking engagement region extends horizontally while a thickness direction of said shielding plate extends in the vertical direction.

2. The electrical connector as claimed in claim 1, wherein each locking arm further includes a horizontal part in front of the locking engagement region, which is embedded in the insulative housing.

3. The electrical connector as claimed in claim 2, wherein the horizontal part intimately electrically and mechanically contacts a front end of one grounding terminal of the upper terminals or the lower terminals.

4. The electrical connector as claimed in claim 3, wherein the horizontal part is sandwiched between front ends of a grounding terminal of the upper terminals and another grounding terminal of the lower terminal in the vertical direction.

5. The electrical connector as claimed in claim 1, wherein each locking arm furthering includes a rear horizontal portion, which extends from the transverse bar and joins with the locking engagement region.

6. An electrical connector comprising:

a contact module, comprising:

an insulative housing comprising a base and a mating tongue extending from the base, the mating tongue including a front mating region and a rear step region, the front mating region defining two opposite mating surfaces and two side faces connecting with the mating surfaces;

two rows of contacts in the insulative housing, the contacts comprising contacting sections exposed upon the mating surfaces of the mating tongue;

a pair of locking arms, each comprising a vertical part vertically attached to each side face of the mating portion, the vertical part being provided with an outwardly protruding locking engagement region sidewardly exposed to an exterior;

a horizontal transverse bar;

wherein the transverse bar is embedded in the base and the pair of locking arms extending forwardly from the transverse bar;

wherein the outwardly protruding locking engagement is dimensioned similar to a thickness of the mating tongue in a vertical direction, and a thickness direction of said locking engagement region extends horizontally while a thickness direction of the mating tongue extends in the vertical direction.

7. The electrical connector as claimed in claim 6, further comprising a shielding plate disposed in the mating tongue and between the two rows of contacts, wherein the shielding plate extends from the transverse bar, but is separated from the pair of locking arms without any connection.

8. The electrical connector as claimed in claim 7, wherein the shielding plate and the pair of locking arms extending from a front edge of the transverse bar.

9. The electrical connector as claimed in claim 6, wherein each locking arm further comprises a horizontal part jointing with a rear end of the locking engagement region and the transverse bar.

10. The electrical connector as claimed in claim 9, wherein a rear region of the vertical part of each locking arm is embedded in the rear step region.

11. An electrical connector comprising:

a shielding shell;

a contact module disposed in the shielding shell and including:

an insulative housing including a base and a tongue portion extending forwardly from the base in a front-to-back direction, the tongue portion forming opposite upper surface and lower surface in a vertical direction a metallic transverse bar embedded within the base;

a metallic shielding plate disposed in the tongue portion between the upper surface and the lower surface and unitarily linked to the transverse bar;

a plurality of upper terminals disposed in the insulative housing with corresponding contacting sections exposed upon the upper surface;

a plurality of lower terminals disposed in the insulative housing with corresponding contacting sections exposed upon the lower surface; and a pair of metallic locking arms extending from two opposite side edges of the shielding plate and attached upon two opposite lateral side edges of the tongue portion; wherein each locking arm has a locking engagement region with an outwardly and laterally facing engagement surface which is dimensioned similar to a thickness of the tongue portion in the vertical direction, and a thickness direction of said locking engagement region extends horizontally while a thickness direction of said shielding plate extends in the vertical direction; wherein each locking arm further includes a horizontal part in front of the locking engagement region, which is embedded in the insulative housing.

12. The electrical connector as claimed in claim 11, wherein the horizontal part electrically and mechanically intimately contacts a front end of at least one grounding terminal of either the upper terminals or the lower terminals.

13. The electrical connector as claimed in claim 12, wherein the horizontal part is sandwiched between front ends of a grounding terminal of the upper terminals and another grounding terminal of the lower terminals.

* * * * *